US008510979B1

(12) United States Patent
Mortimer

(10) Patent No.: US 8,510,979 B1
(45) Date of Patent: Aug. 20, 2013

(54) LIGHT-EMITTING AND LESS-THAN-LETHAL-AGENT-EMITTING APPARATUS

(76) Inventor: Timothy Scott Mortimer, Las Vegas, NV (US)

( * ) Notice: Subject to any disclaimer, the term of this patent is extended or adjusted under 35 U.S.C. 154(b) by 33 days.

(21) Appl. No.: 13/007,964

(22) Filed: Jan. 17, 2011

Related U.S. Application Data

(60) Provisional application No. 61/295,996, filed on Jan. 18, 2010.

(51) Int. Cl.
*F41C 9/00* (2006.01)

(52) U.S. Cl.
USPC ..... 42/1.08; 42/114; 42/146

(58) Field of Classification Search
USPC ..... 42/1.08, 146, 113, 114, 115, 116, 42/117; 362/232, 110, 113, 114; 239/323, 239/313, 589; 222/78, 79, 113, 162, 635
See application file for complete search history.

(56) References Cited

U.S. PATENT DOCUMENTS

| | | | | | |
|---|---|---|---|---|---|
| 3,189,231 | A * | 6/1965 | Kibbel, Jr. et al. | 222/389 |
| 3,282,473 | A * | 11/1966 | Moore | 222/327 |
| 4,068,782 | A * | 1/1978 | Van der Heijden | 222/402.13 |
| 5,425,299 | A * | 6/1995 | Teetzel | 89/14.4 |
| 5,549,220 | A * | 8/1996 | Whalen | 222/1 |
| 5,584,137 | A * | 12/1996 | Teetzel | 42/117 |
| 5,685,105 | A * | 11/1997 | Teetzel | 42/146 |
| 5,787,628 | A * | 8/1998 | Teetzel | 42/1.08 |
| 5,983,548 | A * | 11/1999 | Ludaescher | 42/1.08 |
| 6,022,127 | A * | 2/2000 | Krietzman | 362/259 |
| 6,196,702 | B1 * | 3/2001 | Krietzman | 362/259 |
| D513,334 | S * | 12/2005 | Galey | D26/37 |
| 7,152,990 | B2 * | 12/2006 | Kukuk | 362/112 |
| 7,188,978 | B2 | 3/2007 | Sharrah et al. | |
| D543,446 | S | 5/2007 | DiNenna | |
| D544,621 | S * | 6/2007 | Kim | D26/37 |
| 7,264,369 | B1 * | 9/2007 | Howe | 362/114 |
| 7,421,818 | B2 * | 9/2008 | Houde-Walter | 42/146 |
| 7,523,583 | B2 * | 4/2009 | Cheng | 42/146 |
| 7,644,839 | B2 * | 1/2010 | McNulty, Jr. | 222/79 |
| 8,226,267 | B2 * | 7/2012 | Sharrah et al. | 362/249.05 |
| 2002/0005440 | A1 * | 1/2002 | Holt et al. | 239/284.2 |
| 2002/0148153 | A1 * | 10/2002 | Thorpe | 42/114 |
| 2002/0170988 | A1 * | 11/2002 | Norville et al. | 239/587.1 |
| 2005/0122711 | A1 * | 6/2005 | Matthews et al. | 362/184 |
| 2006/0048843 | A1 * | 3/2006 | Yerby et al. | 141/20 |
| 2006/0175347 | A1 * | 8/2006 | McNulty | 222/79 |

(Continued)

OTHER PUBLICATIONS

D-Cell Maglite Flashlights, "Size Comparison Chart," 1 page, date unknown, printed before Jan. 18, 2010.

(Continued)

*Primary Examiner* — Michael Carone
*Assistant Examiner* — Derrick Morgan
(74) *Attorney, Agent, or Firm* — Khorsandi Patent Law Group; Marilyn R. Khorsandi

(57) ABSTRACT

Exemplary embodiments of the present invention would comprise a light-emitting component and a less-than-lethal-agent-emitting component. An exemplary light-emitting component would comprise an exemplary broad-light-emitting device, such as, for example, a flashlight component, and an exemplary narrow-light-emitting device, such as, for example, a laser light. An exemplary apparatus would further comprise an exemplary less-than-lethal-agent-emitting component, such as, for example, an exemplary lachrymatory-agent-emitting device that would be capable of emitting an exemplary lachrymatory agent.

17 Claims, 15 Drawing Sheets

(56) References Cited

U.S. PATENT DOCUMENTS

| | | | | |
|---|---|---|---|---|
| 2007/0039225 | A1* | 2/2007 | Kallio et al. | 42/146 |
| 2007/0039226 | A1* | 2/2007 | Stokes | 42/146 |
| 2007/0195521 | A1* | 8/2007 | Rosiello | 362/202 |
| 2007/0227056 | A1* | 10/2007 | Howe et al. | 42/146 |
| 2007/0238532 | A1* | 10/2007 | Stethem | 463/47.2 |
| 2007/0277422 | A1* | 12/2007 | Ding | 42/146 |
| 2009/0122527 | A1* | 5/2009 | Galli | 362/110 |
| 2009/0307955 | A1* | 12/2009 | NuDyke | 42/117 |
| 2010/0154279 | A1* | 6/2010 | Polyzos et al. | 42/117 |
| 2010/0162610 | A1* | 7/2010 | Moore et al. | 42/115 |
| 2010/0165613 | A1* | 7/2010 | Rorick | 362/206 |
| 2011/0024460 | A1* | 2/2011 | Smrt et al. | 222/174 |
| 2011/0061283 | A1* | 3/2011 | Cavallo et al. | 42/72 |
| 2012/0124885 | A1* | 5/2012 | Caulk et al. | 42/146 |

OTHER PUBLICATIONS

"Tactical Gun Mount Series—TLR-2(R) with Laser Sight | Streamlight," printed Dec. 16, 2009, 1 page, http://www.streamlight.com/product/product.aspx?pid=81 and 3 pages of photographic images.

"Surefire E2D LED Defender Flashlight—E2DL-BK," printed Dec. 16, 2009, 2 pages, http://www.surefire.com/E2DL, copyright 2009, SureFire, LLC.

"Walther Night Force Laser / Light Combo, Scopes, Walther at Sportsman's Guide," printed Dec. 16, 2009, 3 pages, http://www.sportsmansguide.com/net/cb/walther-night-force-laser-light-combo.aspx?a=5 . . . , copyright 2009, The Sportsman's Guide, Inc., and 1 page of enlarged photographic image.

"Surefire X400(R) LED Weaponlight," printed Dec. 16, 2009, 1 page, http://www.surefire.com/x400.

* cited by examiner

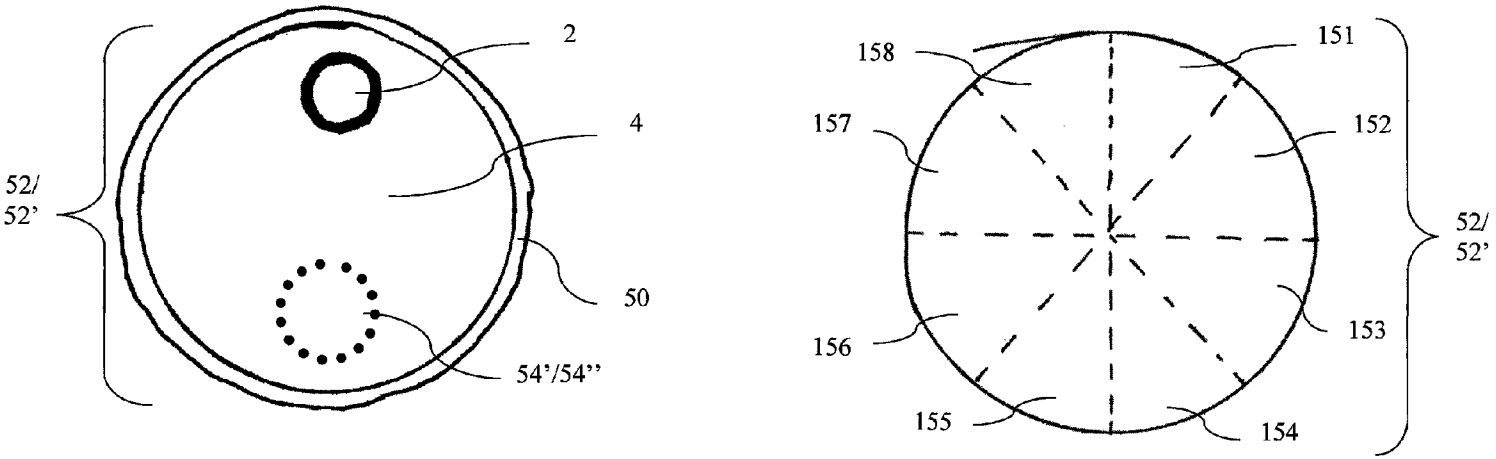
FIG. 2B
FIG. 2A
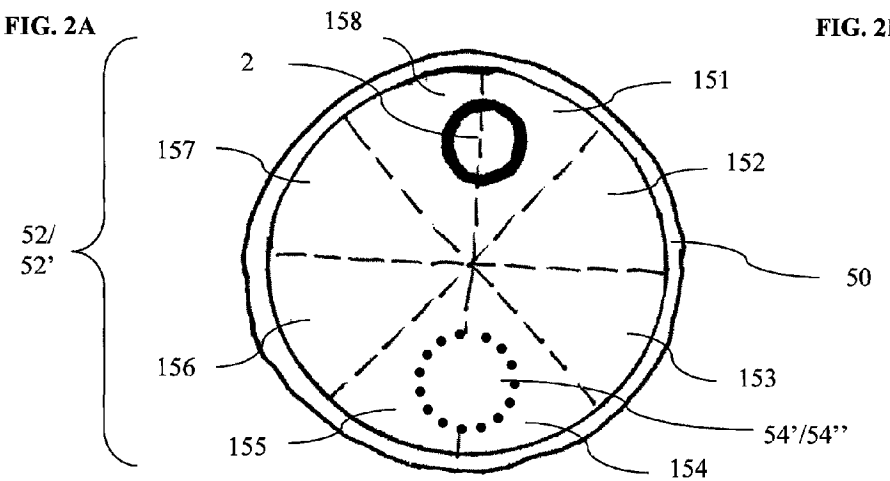
FIG. 2C

LIGHT-EMITTING AND LESS-THAN-LETHAL-AGENT-EMITTING APPARATUS

CROSS-REFERENCE TO RELATED APPLICATIONS

This application claims priority to U.S. Provisional Patent Application No. 61/295,996, titled "LIGHT-EMITTING AND LESS-THAN-LETHAL-AGENT-EMITTING APPARATUS," filed on Jan. 18, 2010, the entire disclosure of which is incorporated by reference herein for all purposes as if stated in full herein.

FIELD OF THE INVENTION

The field of the present invention is light-emitting apparatus, and more specifically, light-emitting and less-than-lethal-agent-emitting apparatus, such as a light-emitting and less-than-lethal-agent-emitting apparatus that may be mountable onto a rail mount of a gun or other weapon, or that may be a standalone, independent device, or a less-than-lethal-agent-emitting apparatus that may be integral to a light-emitting apparatus.

SUMMARY OF THE INVENTION

An exemplary embodiments of the present invention would comprise an apparatus that would be mountable, such as onto a rail mount of a gun or other weapon, and that would comprise a light-emitting component and a less-than-lethal-agent-emitting component. An exemplary light-emitting component would comprise an exemplary broad-light-emitting device, such as, for example, a flashlight component. An exemplary light-emitting component would further comprise an exemplary narrow-light-emitting device, such as, for example, a laser light, such as an exemplary laser-light-emitting device encased within the exemplary flashlight component. The exemplary apparatus may further comprise an exemplary less-than-lethal-agent-emitting component, such as, for example, an exemplary lachrymatory-agent-emitting device. The exemplary lachrymatory-agent-emitting device would be capable of emitting an exemplary lachrymatory agent, such as, for example, pepper spray or oleoresin capsicum, or other such less-than-lethal agent, whether now known or in the future discovered.

Some exemplary embodiments of the present invention may be capable of being used as a standalone device and/or would be mountable, such as onto a rail mount of a gun or other weapon.

Alternative exemplary embodiments of the present invention would comprise an exemplary broad-light-emitting device in which an exemplary narrow-light-emitting device and an exemplary lachrymatory-agent-emitting device are integrally incorporated; such an embodiment may comprise a removable rail mountable element; such an embodiment may be used as a standalone device or may be mounted on a weapon.

One exemplary embodiment of the present invention would comprise: a broad-light-emitting device; a narrow-light-emitting device; and a less-than-lethal-agent-emitting device. In one such exemplary embodiment, said broad-light-emitting device would comprise a flashlight. In one such exemplary embodiment, said narrow-light-emitting device would comprise a laser light. In one such exemplary embodiment, said less-than-lethal-agent-emitting device would comprise a lachrymatory-agent-emitting device. One such exemplary embodiment would further comprise a rail-mounting for attachment of said apparatus to a rail of a weapon. In one such exemplary embodiment, said lachrymatory-agent-emitting device would be adapted for emitting pepper spray, or oleoresin capsicum or other lachrymatory agent, whether now known or in the future discovered. In one such exemplary embodiment, said narrow-light-emitting device and said less-than-lethal-agent-emitting device would be integrally incorporated with said broad-light-emitting device in an exemplary single encasement. In another such exemplary embodiment, said narrow-light-emitting device would be integrally incorporated with said broad-light-emitting device in an exemplary single encasement. In another such exemplary embodiment, said less-than-lethal-agent-emitting device would be integrally incorporated with said broad-light-emitting device in an exemplary single encasement.

One exemplary embodiment would comprise a weapon-mountable apparatus that would comprise: a flashlight element comprising a flashlight enclosure element encasing a light-emitting source for emitting an expansive beam of light; a laser light element that would be encapsulated within said flashlight enclosure element and adapted for emitting a narrow beam of colored light; a less-than-lethal-agent-emitting element that would be adapted for attachment to said flashlight element and for causing a targeted spray of a less-than-lethal agent from said spray container, wherein said less-than-lethal-agent-emitting element would comprise a spray container containing a plurality of less-than-lethal agent molecules, and a spray container holding element that is adapted for holding said spray container; and a rail mounting element adapted for attachment of said flashlight element or said laser light element to a weapon.

BRIEF DESCRIPTION OF THE DRAWINGS

These and other features of the present invention are more fully set forth in the following description of exemplary embodiments of the invention. The description is presented with reference to the accompanying drawings in which:

FIG. 2A depicts a partial front plan view of an exemplary embodiment of the present invention comprising an exemplary flashlight element, an exemplary laser light element, and an optional exemplary less-than-lethal-agent-emitting element;

FIG. 2B comprises a graphic depiction of a front plan view of a flashlight/laser light lens/reflector depicting an exemplary division of the flashlight/laser light lens/less-than-lethal-agent-emitting agent (optional)/reflector into eight exemplary portions, sometimes referred to herein as half-quadrants;

FIG. 2C depicts a superposition of FIGS. 2A and 2B such that a front plan view of an exemplary laser light is illustratively placed within the two top-most half-quadrants of the illustratively eight-way-divided flashlight/laser light lens/less-than-lethal-agent-emitting agent (optional)/reflector;

DETAILED DESCRIPTION OF THE INVENTION

A. An Exemplary Broad-Light-Emitting Device, Such as a Flashlight Element

Figure 1A:
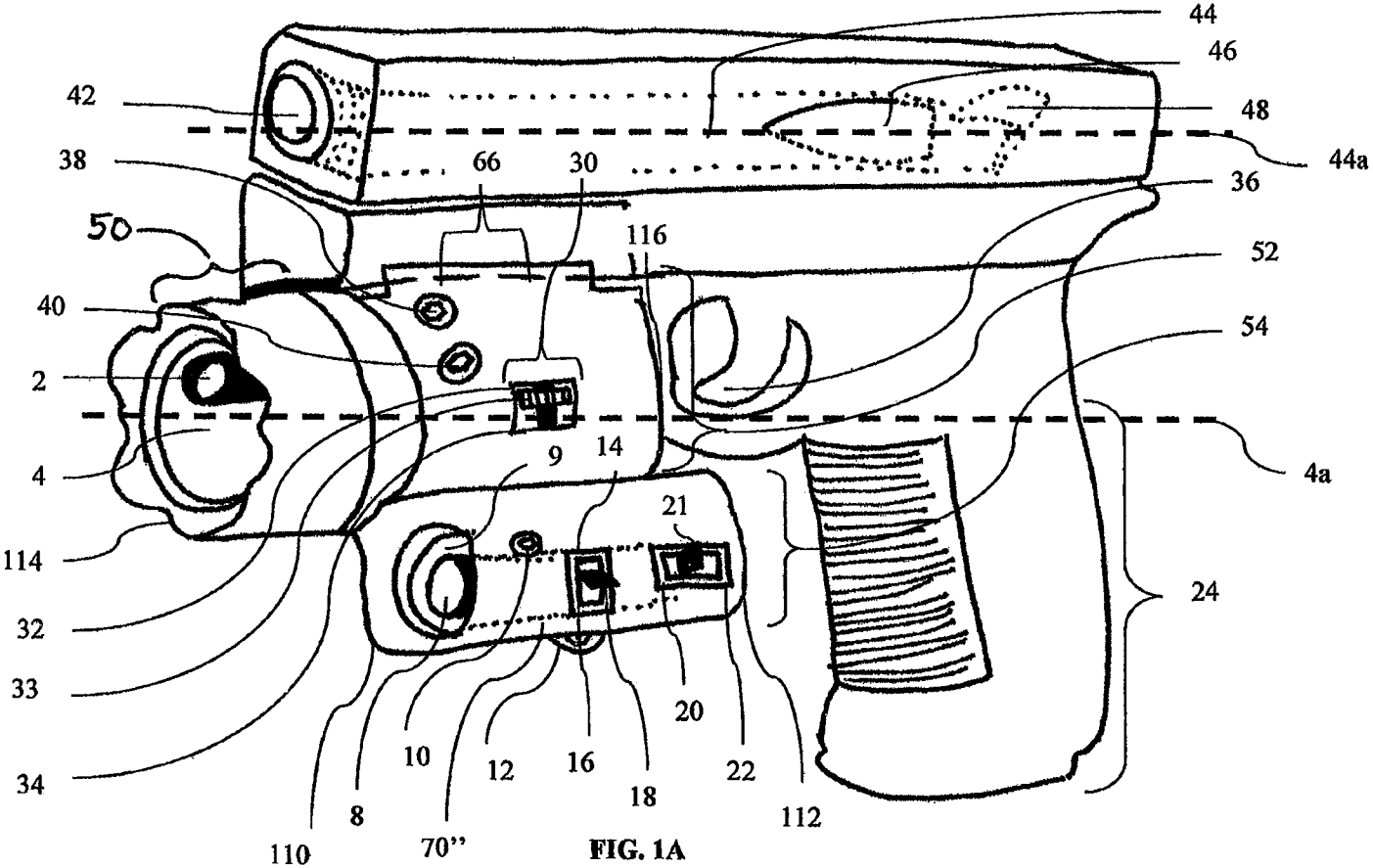
FIG. 1A depicts a side perspective view of an exemplary embodiment of the present invention with an exemplary flashlight element and an exemplary laser light element in an exemplary first enclosure and an exemplary less-than-lethal-agent-emitting element in an exemplary second enclosure, where the exemplary embodiment of the present invention is attached to, or otherwise mounted on, an exemplary embodiment of a weapon.

With reference to FIGS. 1A, 1B, 1C, 1D, 1E, 1F, and 1G an exemplary broad-light-emitting device will comprise a flashlight device, such as exemplary flashlight element 4. Exemplary flashlight element 4 will comprise an exemplary light-emitting source (not shown), which may comprise an exemplary incandescent bulb (not shown) or exemplary light-emitting diode (not shown), or other light-emitting source, whether now known or in the future discovered; said exemplary light-emitting source located at the exemplary posterior end 116 of the exemplary flashlight element 4. The exemplary light-emitting source (not shown) would be capable of emitting an exemplary wide-ranging, yet targeted, beam of light of one of varying exemplary intensities and exemplary colors towards an exemplary anterior end 114 of the exemplary flashlight element 4. As depicted in FIG. 1A, an exemplary embodiment of the present invention will comprise an exemplary handle 24 adapted for grasping by an exemplary user.

Figure 1B:
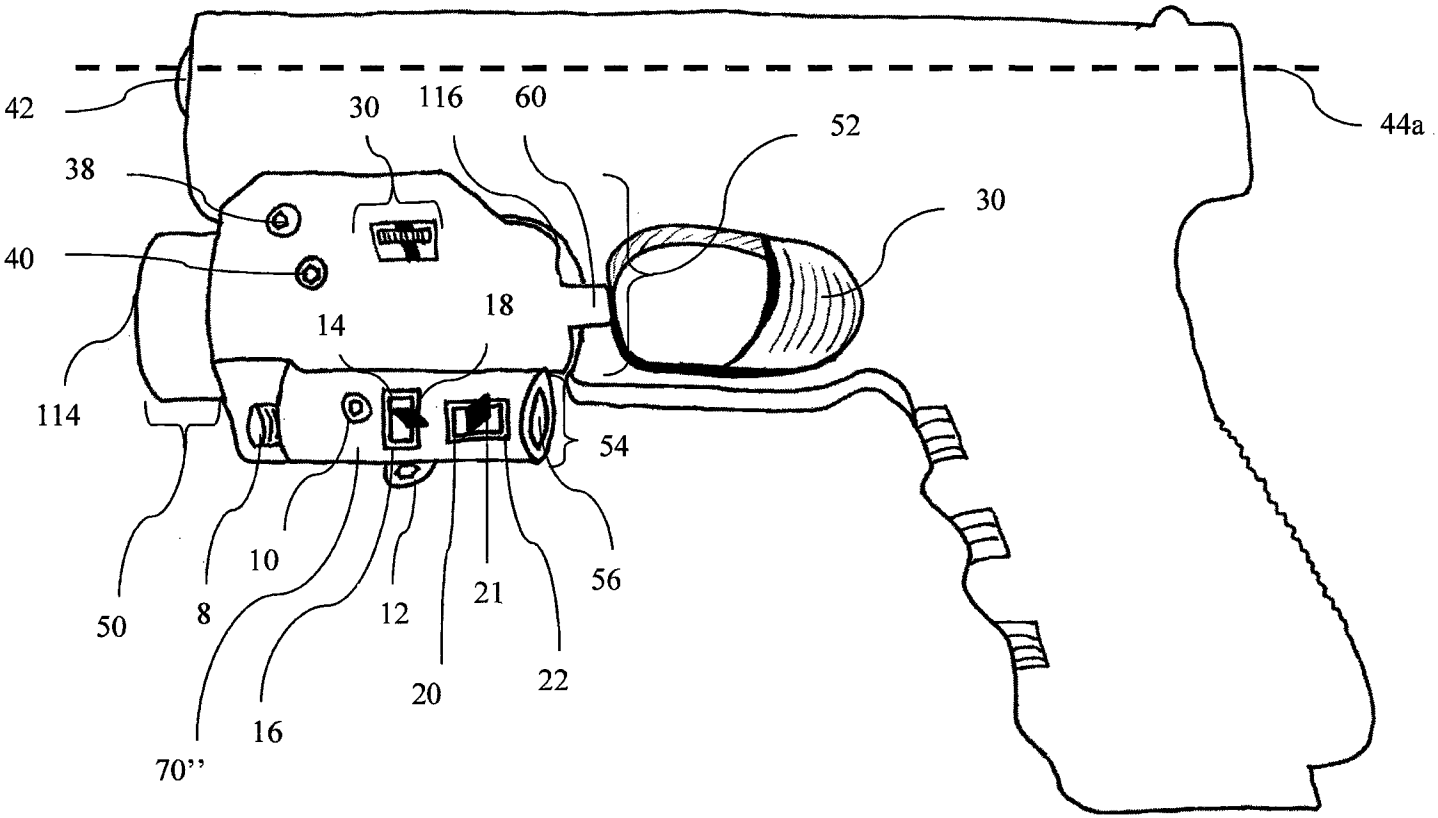
FIG. 1B depicts a side plan view of an exemplary embodiment of the present invention with an exemplary flashlight element and an exemplary laser light element in an exemplary first enclosure and an exemplary less-than-lethal-agent-emitting element in an exemplary second enclosure, where the exemplary embodiment of the present invention is attached to, or otherwise mounted on, an exemplary embodiment of a weapon.
Figure 1C:
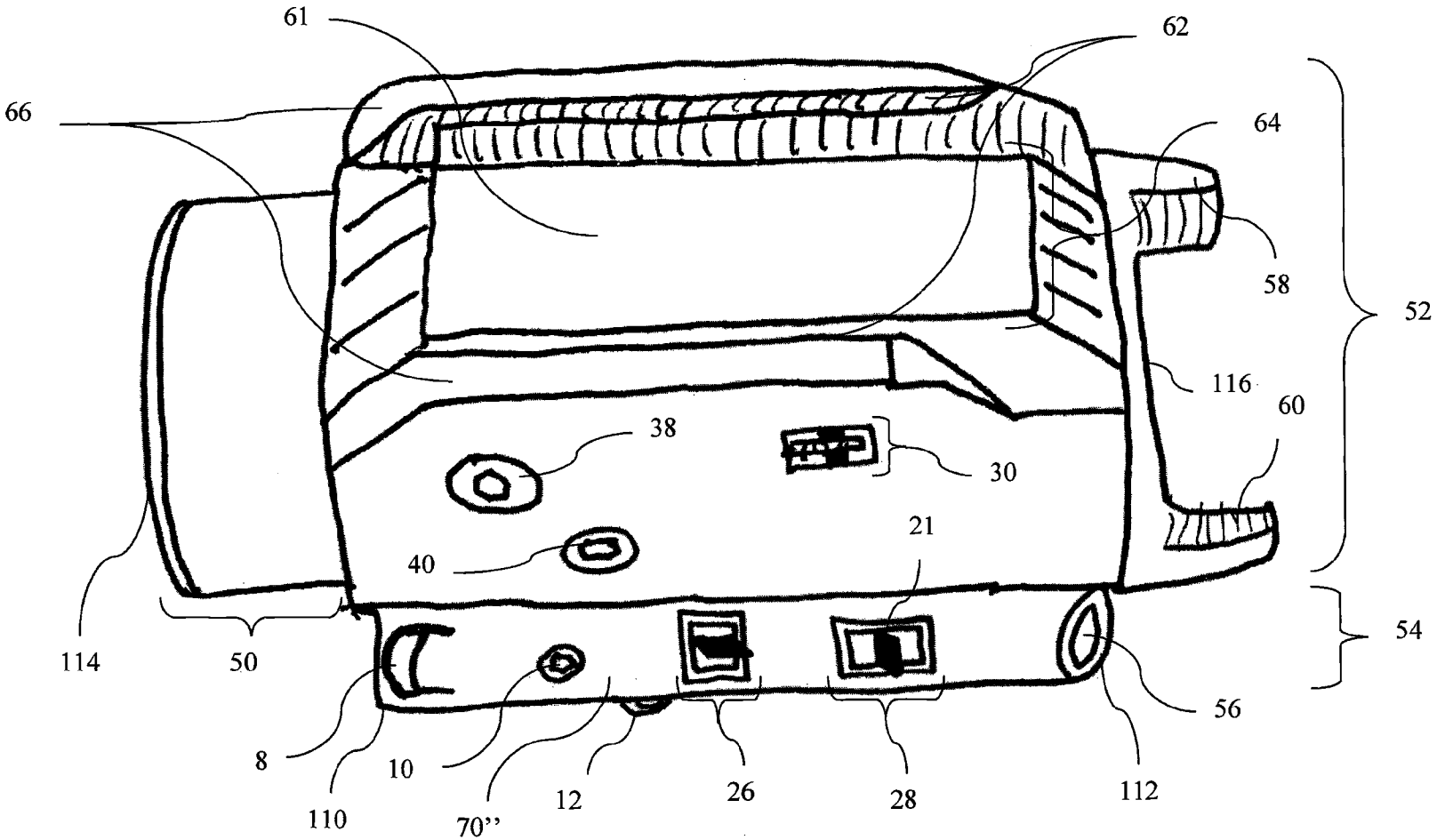
FIG. 1C depicts a top perspective view of an exemplary embodiment of the present invention with an exemplary flashlight element and an exemplary laser light element in an exemplary first enclosure and an exemplary less-than-lethal-agent-emitting element in an exemplary second enclosure, said exemplary embodiment further comprising a rail-mounting for attaching, or otherwise mounting, the exemplary embodiment to an exemplary embodiment of a weapon.
Figure 1D:
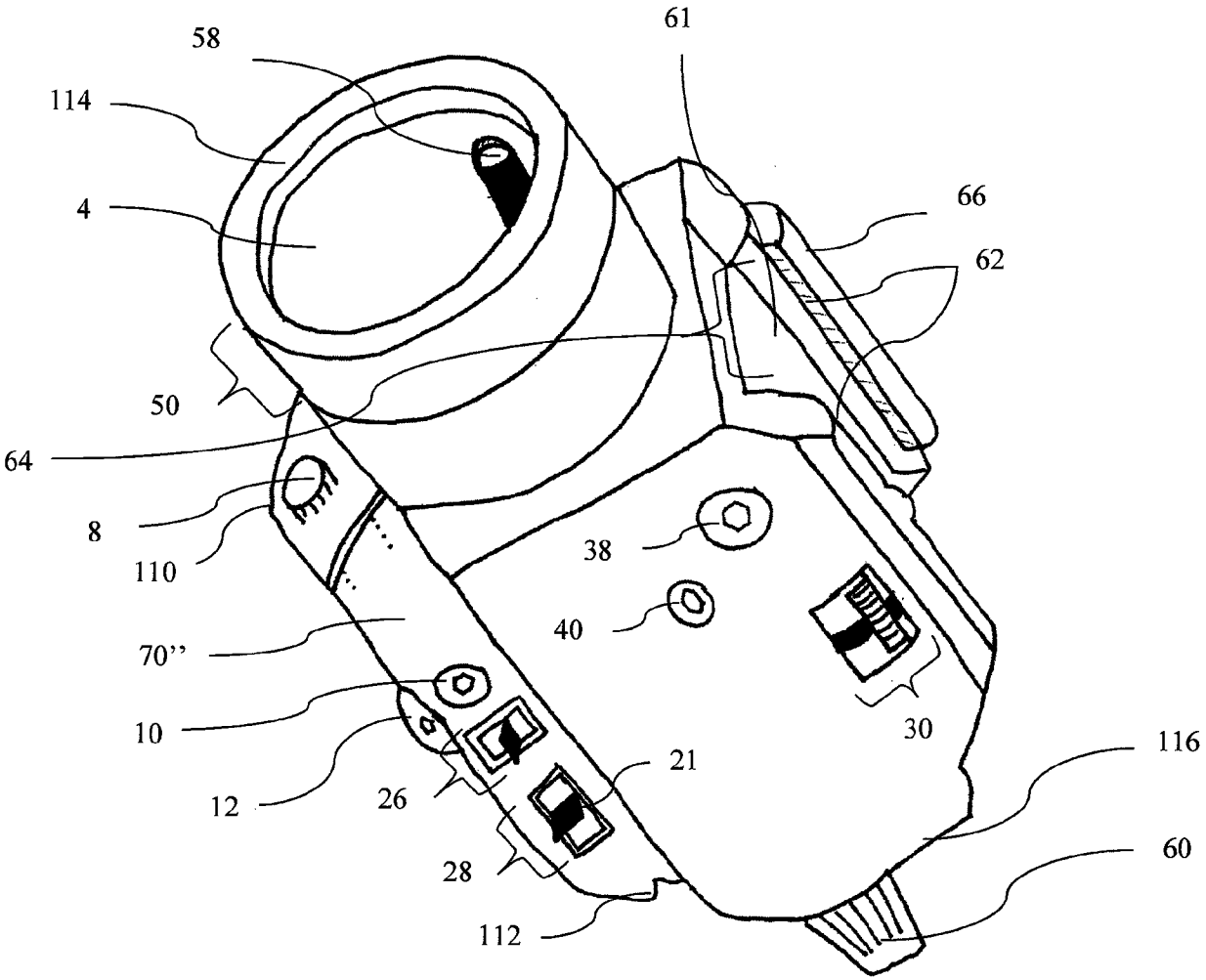
FIG. 1D depicts a side perspective view of an exemplary embodiment of the present invention with an exemplary flashlight element and an exemplary laser light element in an exemplary first enclosure and an exemplary less-than-lethal-agent-emitting element in an exemplary second enclosure, said exemplary embodiment further comprising a rail-mounting for attaching, or otherwise mounting, the exemplary embodiment to an exemplary embodiment of a weapon.
Figure 1E:
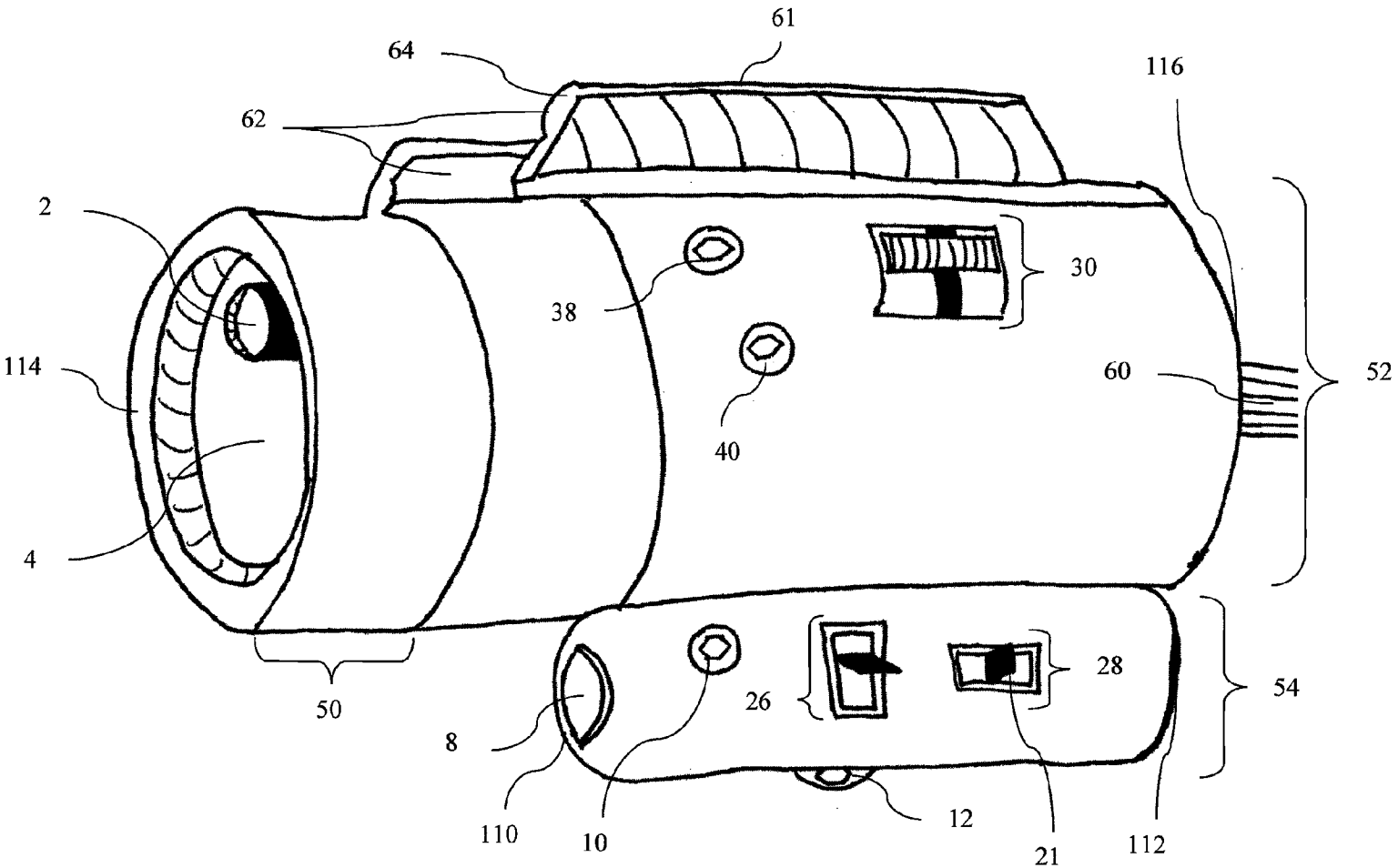
FIG. 1E depicts a side perspective view of an exemplary embodiment of the present invention with an exemplary flashlight element and an exemplary laser light element in an exemplary first enclosure and an exemplary less-than-lethal-agent-emitting element in an exemplary second enclosure, said exemplary embodiment further comprising a rail-mounting for attaching, or otherwise mounting, the exemplary embodiment to an exemplary embodiment of a weapon.
Figure 1F:
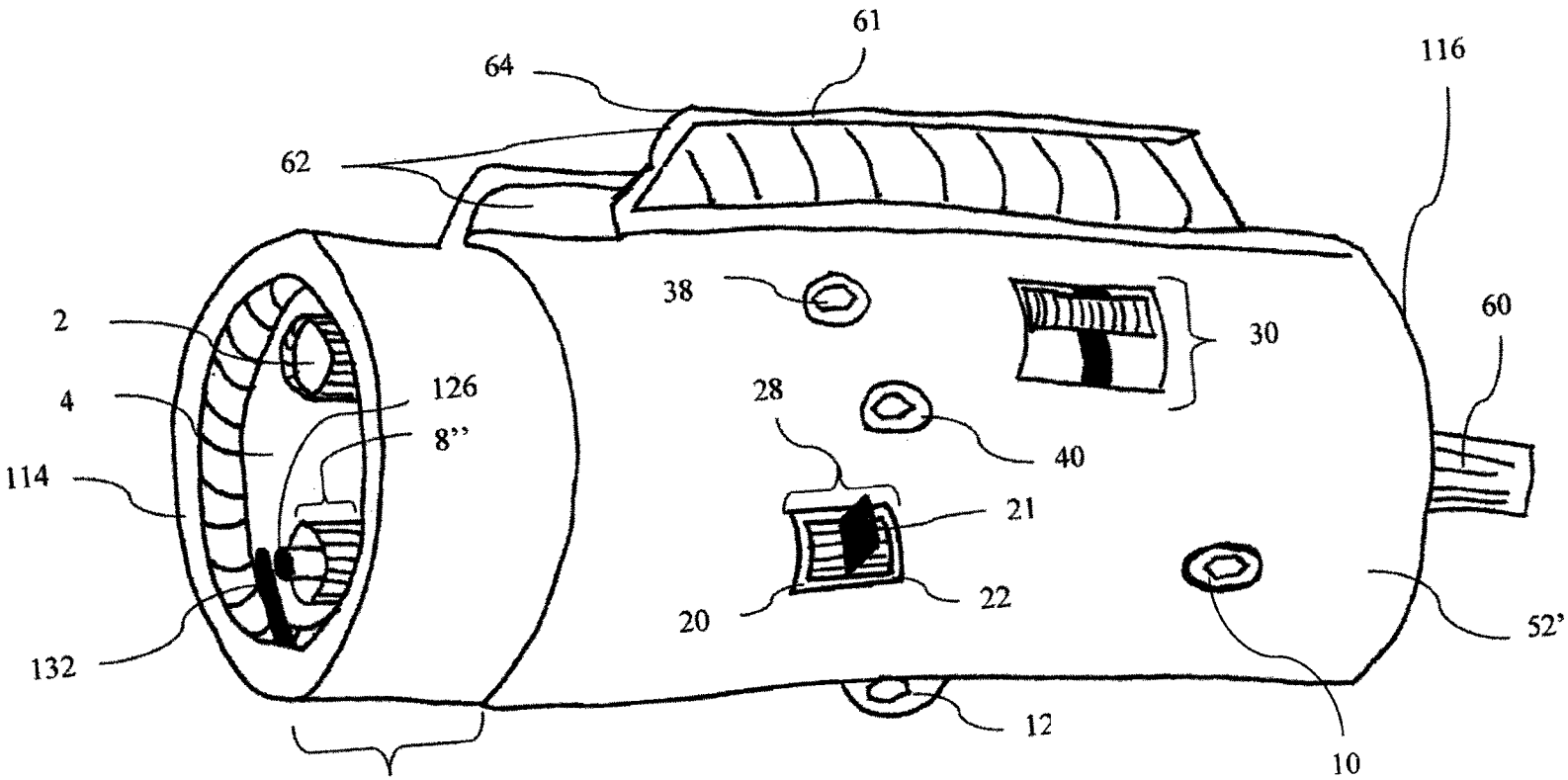
FIG. 1F depicts a side perspective view of an alternative exemplary embodiment of the present invention comprising an exemplary flashlight element, an exemplary laser light element, and an exemplary less-than-lethal-agent-emitting element in an exemplary single enclosure, said alternative exemplary embodiment further comprising an exemplary rail-mounting for attaching, or otherwise mounting, the alternative exemplary embodiment to an exemplary embodiment of a weapon.
Figure 1G:
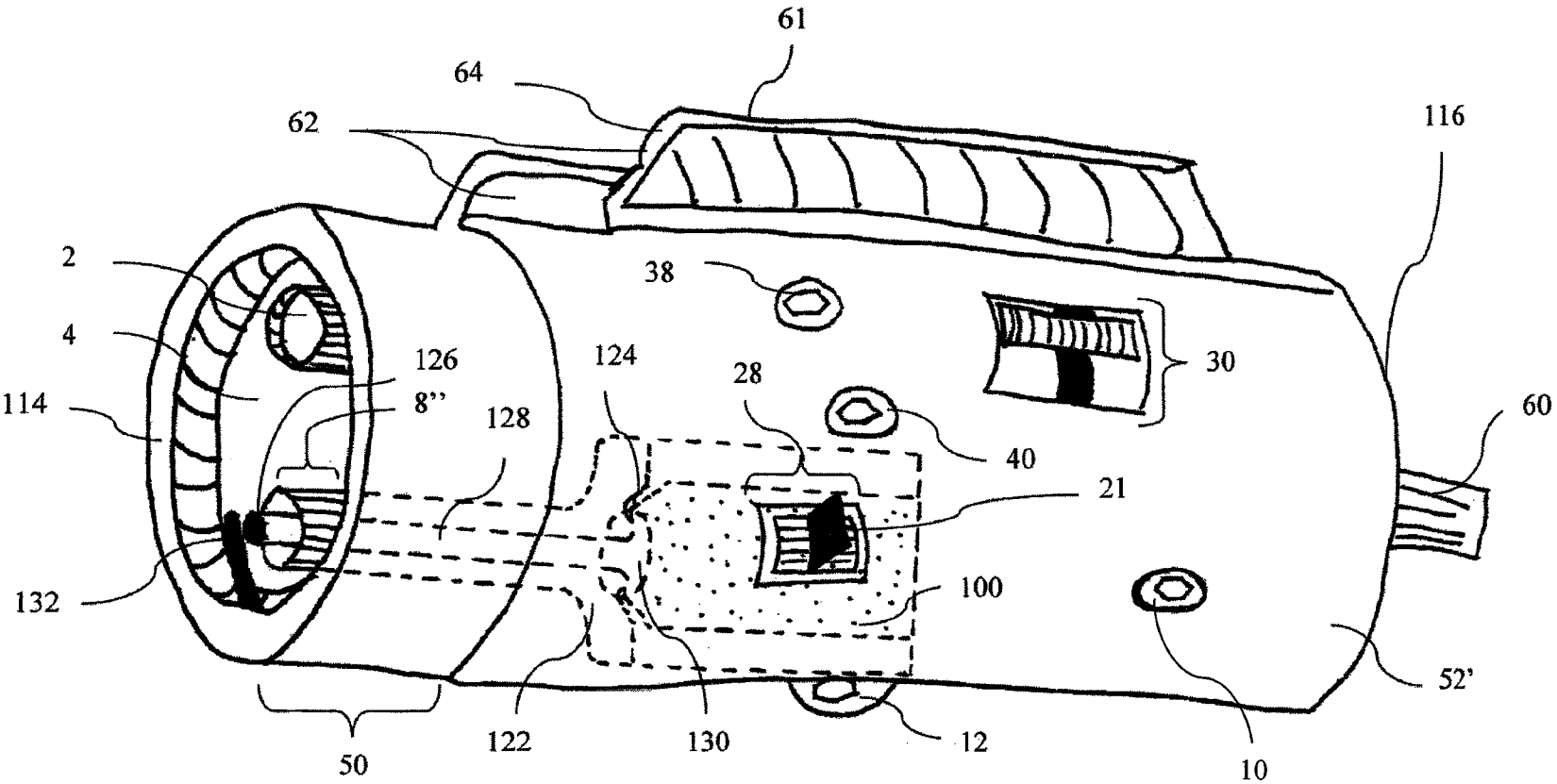
FIG. 1G depicts a side perspective view of an alternative exemplary embodiment of the present invention comprising an exemplary flashlight element, an exemplary laser light element, and an exemplary less-than-lethal-agent-emitting element in an exemplary single enclosure, said alternative exemplary embodiment further comprising an exemplary rail-mounting for attaching, or otherwise mounting, the alternative exemplary embodiment to an exemplary embodiment of a weapon, said side perspective view depicting an exemplary subsurface view of an alternative exemplary embodiment of the less-than-lethal-agent-emitting element comprising an alternative exemplary spray container holding element and an alternative exemplary spray container in a neutral (non-pushed-forward) position.

An exemplary general shape of the exemplary flashlight element 4 will be substantially cylindrical (such as depicted in FIGS. 1A and 1E). There will be an exemplary alignment between the flashlight element 4 and an exemplary longitudinal axis 44*a* of an exemplary barrel 44 of a weapon. The exemplary alignment of the exemplary flashlight element 4 will be parallel to the exemplary longitudinal axis 44*a* of the exemplary barrel 44 of a weapon. The exemplary flashlight element 4 will be mountable underneath the exemplary barrel 44 of the exemplary weapon.

The exemplary broad-light-emitting device, e.g., flashlight element 4, will comprise an exemplary bezel 50. The exemplary bezel 50 of the exemplary flashlight element 4 will comprise a crenellated bezel as shown in FIG. 1A. An alternative exemplary embodiment of the exemplary bezel 50 of the exemplary flashlight element 4 will comprise a non-crenellated bezel, such as depicted, for example, in FIGS. 1B, 1C, 1D, 1E, 1F, and 1G.

One exemplary bezel 50 will extend beyond the anterior edge of the exemplary muzzle 42 of an exemplary weapon. However it will be understood by those of ordinary skill in the art that depiction and reference herein to such exemplary arrangements of, lengths of, and positions of the aforementioned exemplary components and elements of the exemplary flashlight element 4 are illustrative and not a limitation of the invention; other arrangements of, lengths of, shapes of, and/or relative positions of the aforementioned exemplary components and elements of the exemplary broad-light-emitting device could be used without departing from the spirit of the present invention. For example, in various alternative embodiments, the exemplary bezel 50 may be of alternative lengths so that the anterior edge 114 of the exemplary bezel 50 of the exemplary broad-light-emitting element 4 does not extend beyond the anterior edge of exemplary muzzle 42 of an exemplary weapon. By way of another example, the exemplary general shape of an alternative exemplary embodiment of an exemplary broad-light-emitting device, such as exemplary flashlight element 4, and/or of an alternative exemplary embodiment of an exemplary bezel may be substantially square, rectangular (as shown in FIGS. 1C and 1D), polygonal, comprise other non-geometric shapes, or any multitude of combinations thereof.

Continuing with reference to FIGS. 1A, 1B, 1C, 1D, 1E, 1F, and 1G, the exemplary broad-light-emitting device, such as, for example, exemplary flashlight element 4, will comprise an exemplary switch, such as, for example, exemplary flashlight switch 30. Exemplary flashlight switch 30 will be illustratively located on an exemplary side of the exemplary flashlight element 4.

It will be understood by someone with ordinary skill in the art that the exemplary depiction of a position of exemplary flashlight switch 30 as depicted, for example, in FIG. 1A, is illustrative and non-limiting; various alternative positions for exemplary flashlight switch 30 could be used without departing from the spirit of the present invention.

The exemplary broad-light-emitting switch, such as, for example flashlight switch 30, will be adapted to operate as an exemplary means of activating and/or deactivating an exemplary broad-light emitting source (not shown, but previously mentioned), such as, for example, an exemplary incandescent light bulb. The exemplary broad-light-emitting switch, such as, for example, exemplary flashlight switch 30, will comprise an exemplary flashlight switch arm 33 that will be movable from an exemplary flashlight switch top 32 to an exemplary flashlight switch bottom 34, where such movement causes the activation and/or deactivation of the exemplary light-emitting source (not shown).

As depicted in FIG. 1C, some exemplary embodiments of the exemplary flashlight element 4 will further comprise of an exemplary right flashlight latch 58 and/or an exemplary left flashlight latch 60 (as is also depicted in FIGS. 1B, 1C, 1D, 1E, 1F, and 1G) on an exemplary flashlight element 4. Such exemplary flashlight latches 58/60 will be moveable between an up position and a down position (or alternatively, between a left position and a right position) by the user of the exemplary weapon to activate and/or deactivate the light emitting source (not shown) of the exemplary flashlight element 4. However it will be understood by those of ordinary skill in the art that depiction and reference to such an exemplary arrangements of, numbers of, positions of, and movement of, the aforementioned exemplary components and elements of the switches and latches for activating and deactivating the light-emitting source of exemplary flashlight element 4 are illustrative and not a limitation of the invention; other arrangements of, numbers of, positions of and/or movement directions of the aforementioned switches and latches for activating and deactivating the light-emitting source of the exemplary flashlight element could be used without departing from the spirit of the present invention. For example, in various other alternative embodiments, there may be fewer or more than the exemplary quantity of switches 30 and/or exemplary flashlight latches 58/60 as shown in FIGS. 1A, 1B, 1C, 1D, 1E, 1F, and 1G and/or varying dimensions and positions of those exemplary components and elements on or around the exemplary flashlight element 4.

Continuing with reference to FIGS. 1A, 1B, 1C, 1D, 1E, 1F, and 1G, the exemplary material composition of exemplary laser light element 2 would be metal. However, one with ordinary skill in the art will understand that alternative embodiments of laser light element 2 could be alternatively composed of any one or combination of various solid or semi-solid materials, whether now known or in the future discovered, including various metals and plastics.

B. An Exemplary Narrow-Light-Emitting Device, Such as an Exemplary Laser Light Element With reference to FIGS. 1A, 1B, 1C, 1D, 1E, 1F, 1G, 2A, and 2B, an exemplary narrow-light-emitting device 2, such as exemplary laser light element 2 will comprise a light emitting source (not shown) located at an exemplary posterior end 116 of exemplary laser light element 2; exemplary laser light element 2 will further comprise an emitting lens (not shown) located at the anterior end 114 exemplary laser light element 2, through which an exemplary narrow, focused beam of light of various exemplary intensities and varying exemplary colors would be emitted. An exemplary color of an exemplary laser light will be an exemplary shade of the color green or red, which are highly visible colors to a human-eye at distances away from an exemplary target towards which the exemplary narrow beam of light is shined. However, it will be understood by those of ordinary skill in the art that depiction and reference to such a color is merely illustrative and that various alternative embodiments will comprise an exemplary narrow beam of light of various other exemplary colors, such as, but not limited to, alternative shades of white, yellow, blue, orange, pink, violet, and/or any combination thereof. An exemplary general shape of the exemplary laser light element 2 will be substantially cylindrical (as shown in FIGS. 1A, 1D, 1E, 1F, 1G, 2A, and 2C).

The exemplary alignment of the exemplary laser light element 2 will be parallel with an exemplary longitudinal axis 44*a* (see, e.g., FIG. 1A) of an exemplary barrel 44 of a weapon and/or an exemplary longitudinal axis 4*a* of exemplary flashlight element 4. In an exemplary embodiment of the present invention, the exemplary laser light element 2 will be inside an exemplary single casing 52 that also encloses exemplary flashlight element 4. That is, an exemplary, single exemplary outer casing 52 of exemplary flashlight element 4 will also substantially enclose an exemplary smaller-sized laser light element 2.

FIG. 2B depicts eight, exemplary substantially equally-sized divisions (half-quadrants) of an exemplary circle representing an exemplary front, anterior portion of exemplary casing 52 of exemplary laser light element 2. FIG. 2C depicts the eight exemplary half-quadrants 151-158 of FIG. 2B as superimposed over an exemplary anterior cross-section of an exemplary flashlight element 4 and an exemplary laser light element 2 of FIG. 2A, an exemplary position of exemplary laser light element 2 will be within the exemplary two half-quadrants 151/158 nearest to the exemplary barrel 44 and/or muzzle 42. In such an exemplary embodiment, the location of the exemplary laser light 2, specifically in the top-two half-quadrants 151/158, may increase the probability that the emitted laser beam (not shown) from the exemplary laser light 2 will shine on a part of the intended target that will be significantly close to the destination of an exemplary bullet 46 (see FIG. 1A) propelled by an exemplary hammer 48 (see FIG. 1A) through an exemplary barrel 44 and exiting an exemplary muzzle 42. However it will be understood by those of ordinary skill in the art that depiction and reference to such exemplary arrangements of, positions of, and/or dimensions of the aforementioned exemplary components and elements of the exemplary laser light element 2 and/or flashlight element 4 are illustrative and not a limitation of the invention; other arrangements of, positions of, shapes of, and/or dimensions of the aforementioned exemplary components and elements of the exemplary flashlight and laser light element (4 and 2 respectively) could be used without departing from the spirit of the present invention. For example, in various other alternative embodiments, the exemplary laser light 2 could be located in other positions within exemplary casing 52, such as, for example, in half-quadrants 152-157 (depicted in FIGS. 2B and 2C), without departing from the spirit of the present invention.

By way of another example, in various alternative exemplary embodiments, an exemplary laser light element 2 may be located outside of exemplary casing 52 of an exemplary flashlight element 4, and/or an exemplary laser light element 2 may be of greater size, length, width, and/or diameter than the exemplary flashlight element 4.

Continuing with reference to FIGS. 1A, 1B, 1C, 1D, 1E, 1F, 1G, 2A, and 2B, the exemplary laser light element 2 will comprise an exemplary laser light elevation control 38 and/or an exemplary laser light windage control 40. Exemplary laser light elevation control 38 and exemplary laser light windage control 40 will be adapted for minor manipulation and/or calibration of the beam of light (not shown) emitted by the exemplary laser light element 2. An exemplary laser light elevation control 38 will be adapted to cause minor vertical movement of the laser light up and down, such as along a vertical axis, to cause the exemplary emitted beam of laser light to move up and down in order to facilitate the calibration of the ultimate likely destination of the laser light beam (not shown) of an exemplary laser light element 2 to correspond more closely with the ultimate trajectory and/or likely destination of an exemplary bullet 46 (see FIG. 1A). An exemplary laser light windage control 40 will be adapted to cause minor horizontal movement of the laser light beam to cause the exemplary emitted beam of laser light to move left and right, such as along a horizontal axis, in order to facilitate the calibration of the ultimate likely destination of the light beam (not shown) of an exemplary laser light element 2 to correspond more closely with the ultimate trajectory and/or likely destination of an exemplary bullet 46 (see FIG. 1A).

In an exemplary embodiment of exemplary laser light element 2 (such as depicted in FIGS. 1A, 1B, 1C, 1D, 1E, 1F, and 1G), the exemplary laser light windage control 38 and the exemplary laser light elevation control 40 could be manipulated using a mechanical tool, such as, for example, a screwdriver, that will be adapted to fit inside of exemplary cavities or indentations in exemplary laser light windage control 38 and exemplary laser light elevation control 40. Using such a mechanical tool, such as, for example, a screwdriver, in exemplary cavities or indentations in exemplary laser light windage control 38 and exemplary laser light elevation control 40 would permit sufficient force to be transferred through exemplary laser light windage control 38 and exemplary laser light elevation control 40, respectively, to the exemplary laser light element 2 to allow manipulation, adjustment and calibration of the exemplary laser light element 2.

Additionally, in one exemplary embodiment of the laser light element 2 (as shown in FIGS. 1A, 1B, 1C, 1D, 1E, 1F, and 1G), the laser light windage control 38 and the laser light elevation control 40 will be located on only one side of the apparatus. However, it will be understood by those of ordinary skill in the art that depiction and reference to such an exemplary arrangements of, position of, and/or dimensions of the aforementioned exemplary components and elements of the exemplary laser light element 2 and/or flashlight element 4 are illustrative and not a limitation of the invention; other arrangements of, positions of, and/or dimensions of the aforementioned exemplary components and elements of the exemplary laser light element 2 and/or exemplary flashlight element 4 could be used without departing from the spirit of the present invention. For example, in various other alternative embodiments, the laser light windage control 38 and laser light elevation control 40 may be adapted to be operable with respective knobs, so that a separate tool, such as a screwdriver, would not be necessary to adjust the laser light.

By way of another example, in various alternative exemplary embodiments, instead of being encapsulated within the same casing that encapsulates the flashlight element 4, an exemplary laser light element 2 may be located on one or the other lateral side of the flashlight element 4, or underneath the flashlight element 4.

The exemplary material composition of exemplary laser light element 2 would be metal. However, one with ordinary skill in the art will understand that laser light element 2 could be alternatively composed of any one or combination of various solid or semi-solid materials, whether now known or in the future discovered, including various metals and plastics, without departing from the spirit of the present invention.

C. An Exemplary Mounting Device Such as an Exemplary Rail Mounting Element

With reference to FIGS. 1C, 1D, 1E, 1F, and 1G, an exemplary embodiment of the present invention will comprise an exemplary mounting device 61, such as exemplary rail mounting element 61 that will be adapted for attaching, or otherwise mounting, an exemplary flashlight element 4 onto an exemplary weapon. An exemplary rail mounting element 61 will comprise a rail mounting receiving cavity 64 into which a rail mount (not shown) of an exemplary weapon may be slidably inserted, such as along a longitudinal axis of exemplary rail mounting element 61; slidably inserting a rail mount (not shown) of an exemplary weapon into rail mounting receiving cavity 64 would result in exemplary contact by some portion of the rail mount (not shown) of an exemplary weapon with exemplary lateral rail mounting lip(s) 66. Each respective exemplary lateral rail mounting lip 66 will comprise a respective, exemplary rail mounting lip inner surface 62. Slidably inserting a rail mount (not shown) of an exemplary weapon into rail mounting receiving cavity 64 would result in exemplary contact between the weapon's rail mount ridges (not shown) along and underneath the respective, exemplary rail mounting lip inner surface 62, Exemplary lateral rail mounting lip(s) 66 will comprise an exemplary inward curvature towards a medial axis of the rail mounting receiving cavity 64. The exemplary inward curvature (towards the medial axis of the rail mounting receiving cavity 64) of the exemplary lateral rail mounting lip(s) 66 will enable the secure attachment of the exemplary flashlight element 4 (with exemplary laser light element 2) to the subject weapon, and would tend to prevent the inadvertent dislodgement of the exemplary flashlight element 4 from the exemplary rail mount (not shown) of the exemplary weapon. Upon insertion of the weapon's exemplary rail mount (not shown) into the rail mounting receiving cavity 64 following the slidable insertion of the weapon's rail mount ridges (not shown) along and underneath the exemplary rail mounting lip inner surface 62, an exemplary embodiment of the present invention will be substantially secured onto the exemplary weapon.

However it will be understood by those of ordinary skill in the art that depiction and reference to such an exemplary arrangement of the aforementioned exemplary components and elements of the exemplary rail mounting element 61 are illustrative and not a limitation of the invention; other functionally equivalent arrangements of the aforementioned exemplary components and elements could be used without departing from the spirit of the present invention. For example, in various alternative embodiments, the present invention will comprise the exemplary rail mounting element 61 being attached to the laser light element 2, instead of the flashlight element 4. Also, in various alternative embodiments, the present invention will comprise an exemplary non-slidable means for attaching and/or securing the exemplary weapon's rail mount (not shown) to an exemplary flashlight element 4 or laser light element 2, such as, by way of non-limiting example, an exemplary clasp (not shown), optionally spring-assisted (not shown), or a screw-assisted tightening assembly (not shown).

Alternatively, with rail mount variations, alternative versions of the lateral rail mounting lips (not shown) could fit inside a rail mount slot rather than over a rail mount.

D. An Exemplary Less-Than-Lethal-Agent-Emitting Element

With reference to FIGS. 3A, 3B, 3C, and 3D, an exemplary embodiment of the present invention will comprise an exemplary less-than-lethal-agent-emitting device, such as exemplary less-than-lethal-agent-emitting element 54'. Exemplary less-than-lethal-agent-emitting element 54' will comprise an exemplary spray container support 75' that will be adapted to hold an exemplary spray container 70', which would contain a plurality of exemplary less-than-lethal agent molecules 100. The exemplary less-than-lethal agent molecules 100 will comprise any one, or various combinations, of exemplary lachrymatory agent(s), such as, for example, oleoresin capsicum, commonly known as pepper spray, or OC gas, or capsicum spray, which are exemplary chemical compounds that irritate an eye to cause pain, tears, or even temporary blindness, and may be used, for example, in personal, self-defense or law enforcement self-defense, assault, riot control, or crowd control, in addition to many other applications.

Exemplary spray container 70' will comprise an exemplary nozzle 8' located in an exemplary nozzle housing cavity 9 and will be adapted for emitting exemplary less-than-lethal agent molecules 100.

Figure 3A:
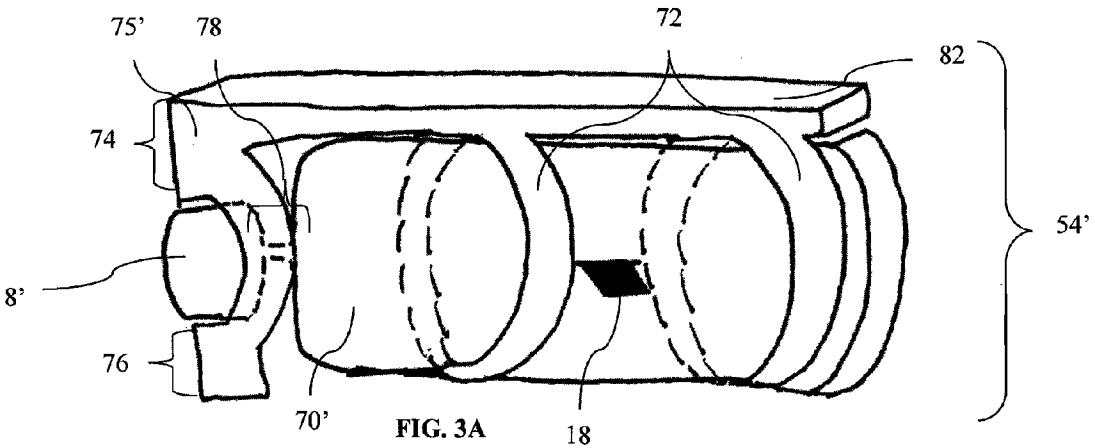
FIG. 3A depicts a side perspective view of an exemplary embodiment of an exemplary less-than-lethal-agent-emitting element with an exemplary spray-container-holding element, with the exemplary spray container in a fully retracted (non-pushed-down) position.
Figure 3B:
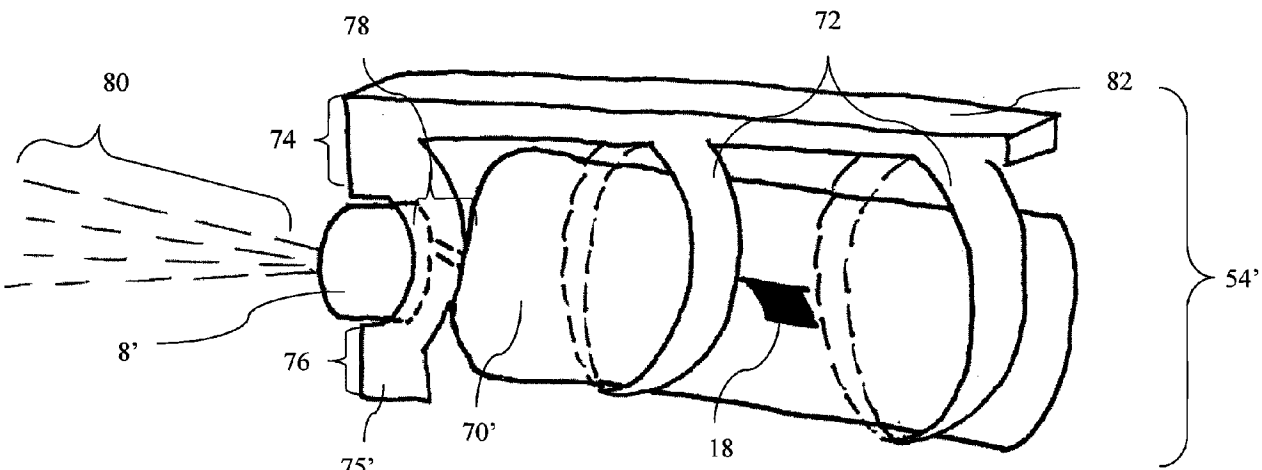
FIG. 3B depicts a side perspective view of an exemplary embodiment of the less-than-lethal-agent-emitting element with an exemplary spray-container-holding element and with the exemplary spray container in a fully extended (pushed-down) position.

With reference to FIGS. 3A and 3B, the exemplary spray container support 75' will comprise an exemplary rigid spray nozzle support top portion 74 and an exemplary rigid spray nozzle support bottom portion 76 that are adapted to hold and retain exemplary nozzle 8', which may be located in an exemplary nozzle housing cavity 9, in an exemplary fixed position, pointing in the same direction as the exemplary anterior 114 of exemplary barrel 44 of the exemplary weapon. Exemplary rigid spray nozzle support top portion 74 and exemplary rigid spray nozzle support bottom portion 76 would be adapted to further hold and retain exemplary nozzle 8' in an exemplary fixed position that is parallel with the exemplary longitudinal axis 44*a* of the exemplary barrel 44 and the exemplary longitudinal axis 4*a* of the exemplary flashlight element 4. Such an exemplary embodiment will be adapted to maintain the exemplary nozzle 8' in an exemplary fixed position in order to allow for an unchanging direction, relative to the exemplary weapon, of exemplary targeted spray 80 (as depicted in FIG. 3B) of less-than-lethal agent molecules 100, even at times when the exemplary other portions of the exemplary spray container 70' will be moving and/or bending (as shown in FIGS. 3B and 3D).

However, it will be understood by those of ordinary skill in the art that depiction and reference to such exemplary arrangements of and/or dimensions of the aforementioned exemplary components and elements of the exemplary spray container support 75' are illustrative and not a limitation of the invention; other arrangements of, and/or dimensions of, the aforementioned exemplary components and elements of the exemplary embodiment of the present invention could be used without departing from the spirit of the present invention. For example, the exemplary length of the exemplary nozzle 8' may be shorter, longer, or equal to the exemplary length of the exemplary spray nozzle support top portion 74 and/or the exemplary rigid spray nozzle support bottom portion 76.

Further, in some exemplary embodiments (see element 10 and 12, respectively, in, e.g., FIGS. 1F and 1G), elevation and windage controls would be provided to facilitate calibration of the direction of the less-than-lethal agent spray to correspond more closely with the ultimate trajectory and/or likely destination of an exemplary bullet 46 (see FIG. 1A).

Figure 3C:
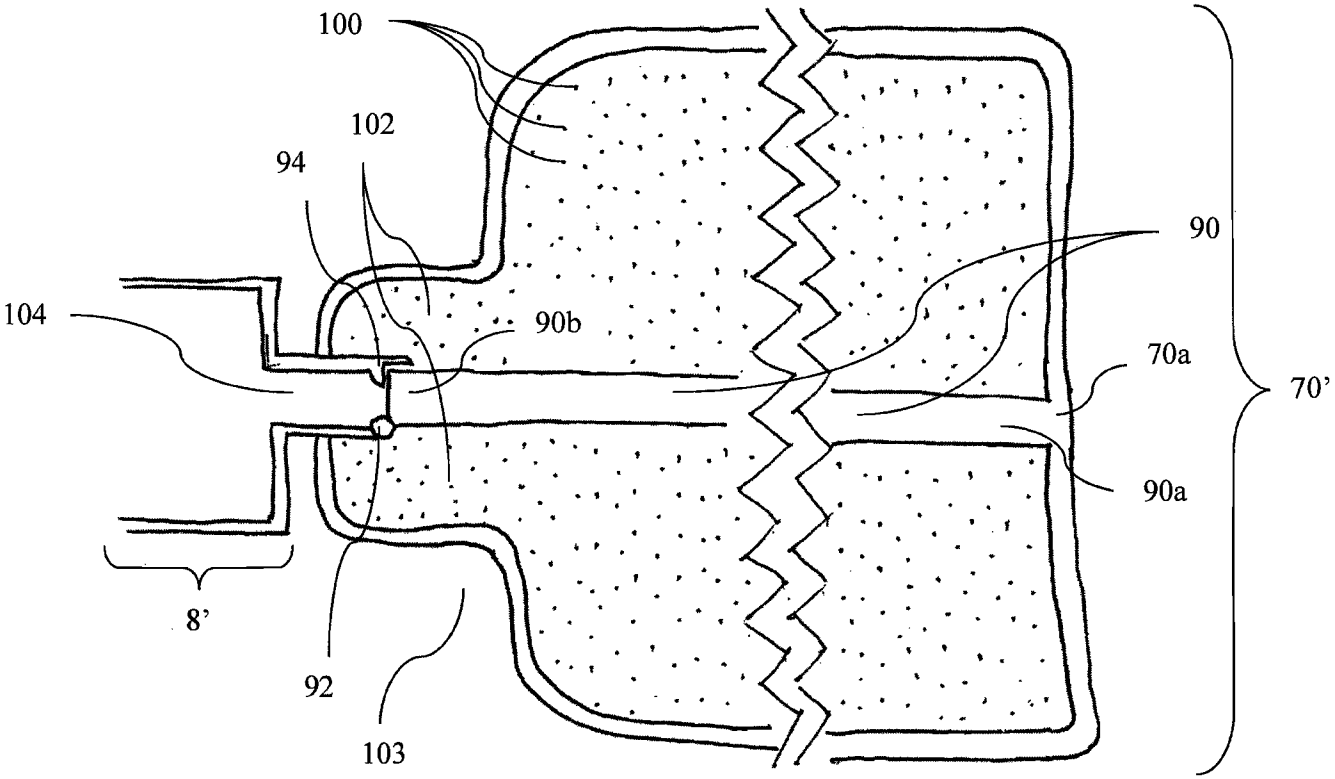
FIG. 3C depicts a cross-sectional view of an exemplary embodiment of a less-than-lethal-agent-emitting element (e.g., underneath the exemplary spray container holding element) with the exemplary spray container in a neutral, fully retracted (non-pushed-down) position.
Figure 3D:
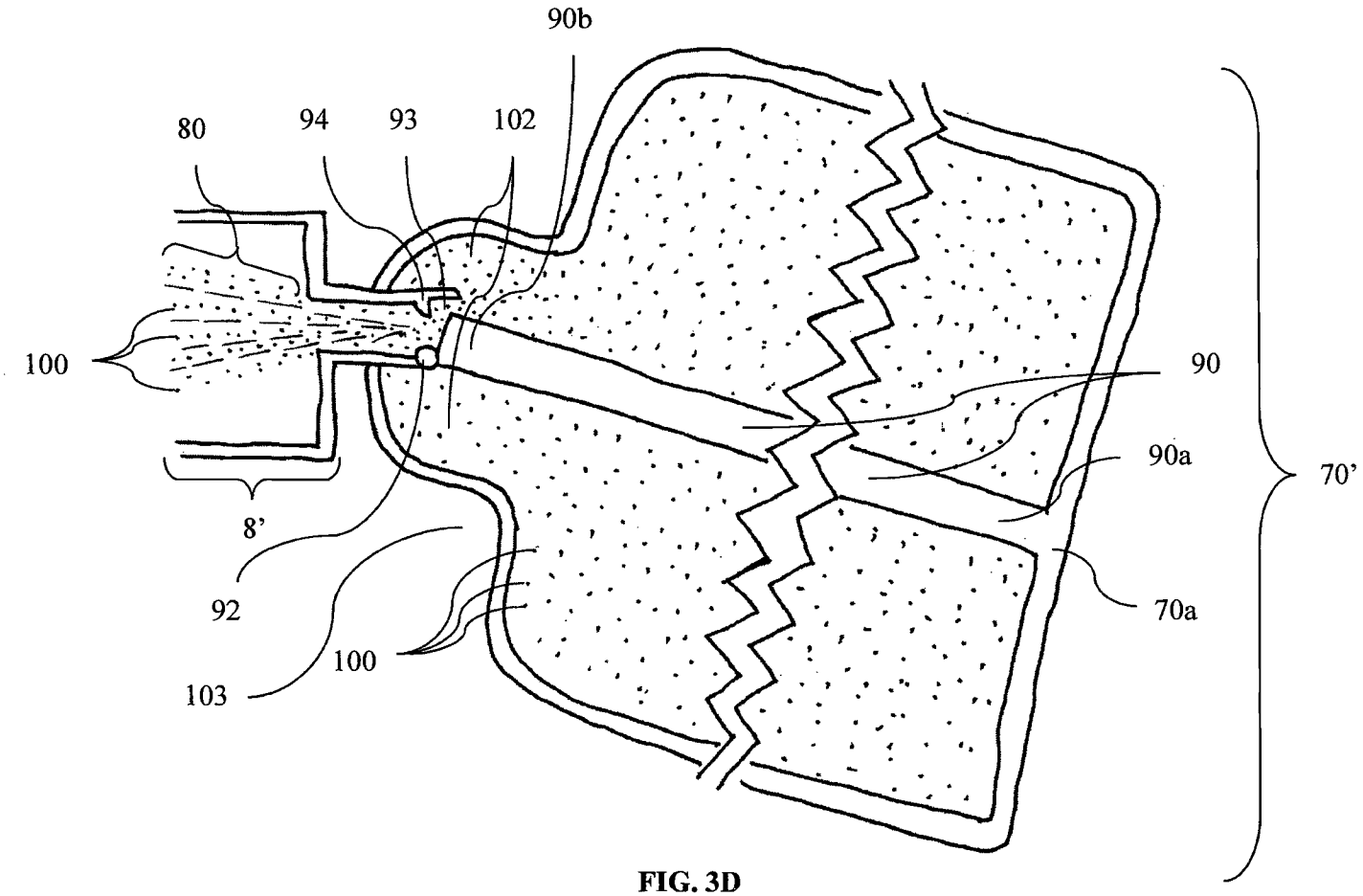
FIG. 3D depicts a cross-sectional view of an exemplary embodiment of the less-than-lethal-agent-emitting element (e.g., underneath the exemplary spray container holding element) with the exemplary spray container in the fully extended (pushed-down) position.

With reference to FIGS. 3A, 3B, 3C, and 3D, the exemplary spray container 70' will comprise an exemplary nozzle 8' located at an anterior end 110 (as seen in FIG. 1A) and an exemplary bendable nozzle-container connection, such as, for example, exemplary rod-nozzle hinge 92 (as depicted in FIGS. 3C and 3D) located immediately behind the exemplary nozzle 8'. As shown in FIGS. 3C and 3D, the exemplary spray container 70' will comprise an exemplary spray container interior space 102, which will contain an exemplary plurality of exemplary less-than-lethal agent molecules 100 in an exemplary concentration that will be higher than an exemplary concentration of the less-than-lethal agent molecules 100 relative to an exemplary spray container exterior space 103. Further, the exemplary spray container 70' will comprise an exemplary rigid rod 90 in an exemplary center of the exemplary spray container 70'. At one exemplary end 90*a*, the exemplary rigid rod 90 will be connected to the exemplary back end portion 70*a* of the exemplary spray container 70'; at a second exemplary end 90*b*, the exemplary rigid rod 90 will be connected to an exemplary rod-nozzle hinge 92 of the exemplary spray container 70'.

The exemplary function of the exemplary rigid rod 90 will be to transfer the downward movements and/or motions of the exemplary adjustably-moving posterior portion of the exemplary spray container (as shown in FIGS. 3B and 3D) to the exemplary rod-nozzle hinge 92. The exemplary rod-nozzle hinge 92 will be connected to the exemplary rigid rod 90 at end 90*b* at one exemplary side (of the exemplary rod-nozzle hinge 92) as well as to an exemplary lower-back-end side (as shown in FIGS. 3C and 3D) of the exemplary nozzle 8' at a second exemplary side (of the exemplary rod-nozzle hinge 92) (as shown in FIGS. 3C and 3D). The exemplary pivotal attachment and/or connection between the exemplary nozzle 8', which will be in an exemplary fixed, non-movable state due to the exemplary fixed, rigid nature of the exemplary rigid spray nozzle support top portion 74 (see FIGS. 3A and 3B) and exemplary rigid spray nozzle support bottom portion 76 (see FIGS. 3A and 3B), and exemplary rigid rod 90, which will be in an exemplary movable state due to the exemplary elastic spray container retention band(s) 72, will allow the exemplary rod-nozzle hinge 92 to function as a hinge between the exemplary rigid rod 90 and exemplary nozzle 8'.

The exemplary exterior surface of the exemplary spray container 70' will further comprise an exemplary spray container push-down arm 18 (see FIGS. 3A and 3B), an exemplary spray container push-down arm upper end 14 (see FIGS. 1A and 1B) and an exemplary spray container push-down arm lower end 16 (see FIGS. 1A and 1B). The exemplary spray container push-down arm 18 will be adapted to receive a downward force by an exemplary user toward the exemplary spray container push-down arm lower end 16. In the exemplary embodiment, exemplary spray container push-down arm lower end 16 would be adapted to provide an exemplary lower limit for exemplary spray container push-down arm 18. As depicted in FIG. 3B, an exemplary user-applied push-down force on the exemplary spray container push-down arm 18 will cause the exemplary posterior portion of the exemplary spray container 70' to move downward as depicted in FIGS. 3B and 3D, thereby causing the exemplary rod-nozzle seal 94 to separate from the exemplary rigid rod 90 and create an exemplary hinge-induced separation 93 to allow an exemplary rapid movement of the exemplary less-than-lethal agent molecules 100 through an exemplary nozzle interior space 104 in the form of an exemplary targeted spray 80 (as shown in FIG. 3D).

Upon the cessation of an exemplary user-applied force on the exemplary spray container push-down arm 18 toward said exemplary spray container push-down arm lower end 16, the exemplary rod-nozzle hinge 92 will cause the movement of the exemplary rigid rod 90 to return to an exemplary retracted position (and the corresponding return of exemplary spray container push-down arm 18 toward exemplary spray container push-down arm upper end 14) such that the exemplary rod-nozzle seal 94 will contact and create an exemplary seal with the exemplary rigid rod 90, thereby preventing further escape of additional less-than-lethal agent molecules 100 (see FIGS. 3A and 3C). This exemplary arrangement would permit for the convenient forward-direction rapid-release of exemplary less-than-lethal agent molecules 100 while the exemplary user of the exemplary embodiment points the exemplary distal end of the exemplary apparatus at an exemplary target by using his/her index finger to apply downward pressure on the exemplary spray container push-down arm 18, which may already be nearby the exemplary push-down arm 18 due to the exemplary push-down arm's 18 proximity to the exemplary trigger 36. In an alternative embodiment, an exemplary user's thumb or index finger could be used to apply pressure to the exemplary spray container push-down arm 18, or depending on the user's left-hand/right-hand orientation and depending on the side of the alternative exemplary embodiment apparatus on which the exemplary spray container push-down arm 18 is located.

It will be understood by someone with ordinary skill in the art that the depictions herein of a left-handed-orientation of the exemplary apparatus, and/or a right-handed-orientation of the exemplary apparatus, are illustrative and non-limiting. In some alternative embodiments, exemplary spray container push down arm 18 and/or exemplary spray container push-forward arm 21 (discussed further below) could be place on both sides of the apparatus to accommodate both left-handed and right-handed users.

It will be understood by those of ordinary skill in the art that depiction and reference to such exemplary arrangements of, exemplary dimensions of, exemplary connection points of and/or exemplary movement directions of the exemplary rigid rod 90, exemplary rod-nozzle hinge 92, exemplary rod-nozzle seal 94, exemplary nozzle 8', and/or exemplary spray container push-down arm 18 are illustrative and not a limitation of the invention; other arrangements of and/or dimensions of and/or movements of the aforementioned exemplary components and elements of the exemplary embodiment of the present invention could be used without departing from the spirit of the present invention. For example, in various alternative exemplary embodiments, the connection between the exemplary rigid rod 90 and the exemplary nozzle 8' at the exemplary rod-nozzle hinge 92 may be at the top-right corner of the exemplary nozzle 8' (not shown, but see FIGS. 3C and 3D) and/or the exemplary direction of movement of the exemplary posterior portion of the exemplary spray container 70' may be in the upwards.

E. An Alternative Exemplary Less-Than-Lethal-Agent-Emitting-Agent Element

With reference to FIGS. 4A, 4B, 4C, and 4D, an alternative exemplary embodiment of the present invention will comprise an exemplary less-than-lethal-agent-emitting element 54", which will comprise an alternative exemplary spray container support 75" (FIGS. 4C and 4D) that will be adapted to hold an alternative exemplary spray container 70", which contains a plurality of exemplary less-than-lethal agent molecules 100. The exemplary less-than-lethal agent molecules 100 may comprise any one of, or various combinations of, exemplary lachrymatory agent(s), such as, for example, oleoresin capsicum, commonly known as pepper spray, OC gas, or capsicum spray, which are exemplary chemical compounds that irritate an eye to cause pain, tears, or even temporary blindness, and may be used, for example, in personal self-defense or law enforcement self-defense, assault, riot control, or crowd control, in addition to many other applications.

Figure 4A:
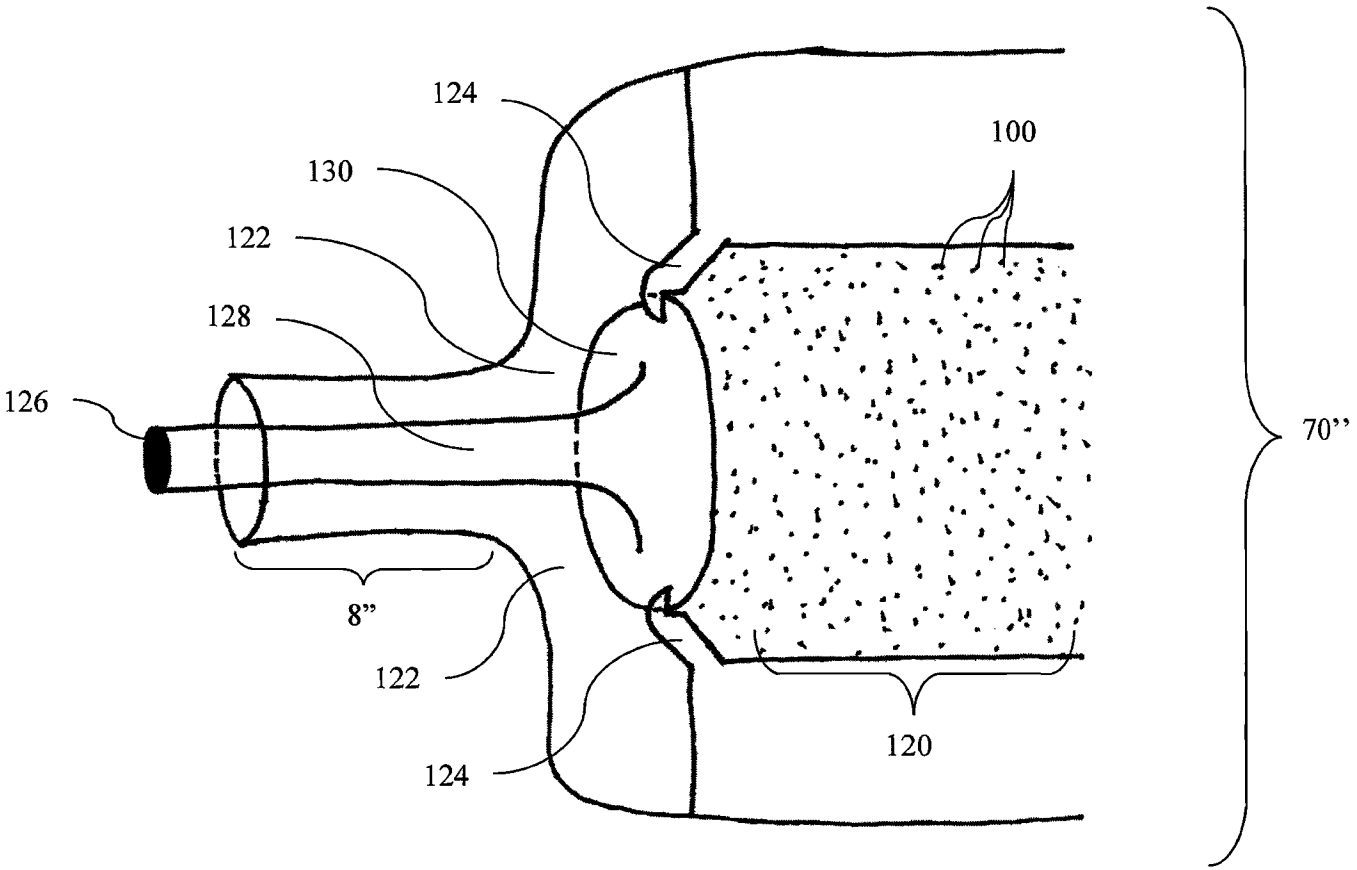
FIG. 4A depicts a cross-sectional view of an alternative exemplary embodiment of a less-than-lethal-agent-emitting element (e.g., underneath the alternative exemplary spray container holding element) with the alternative exemplary spray container in a neutral (non-pushed-forward) position.
Figure 4B:
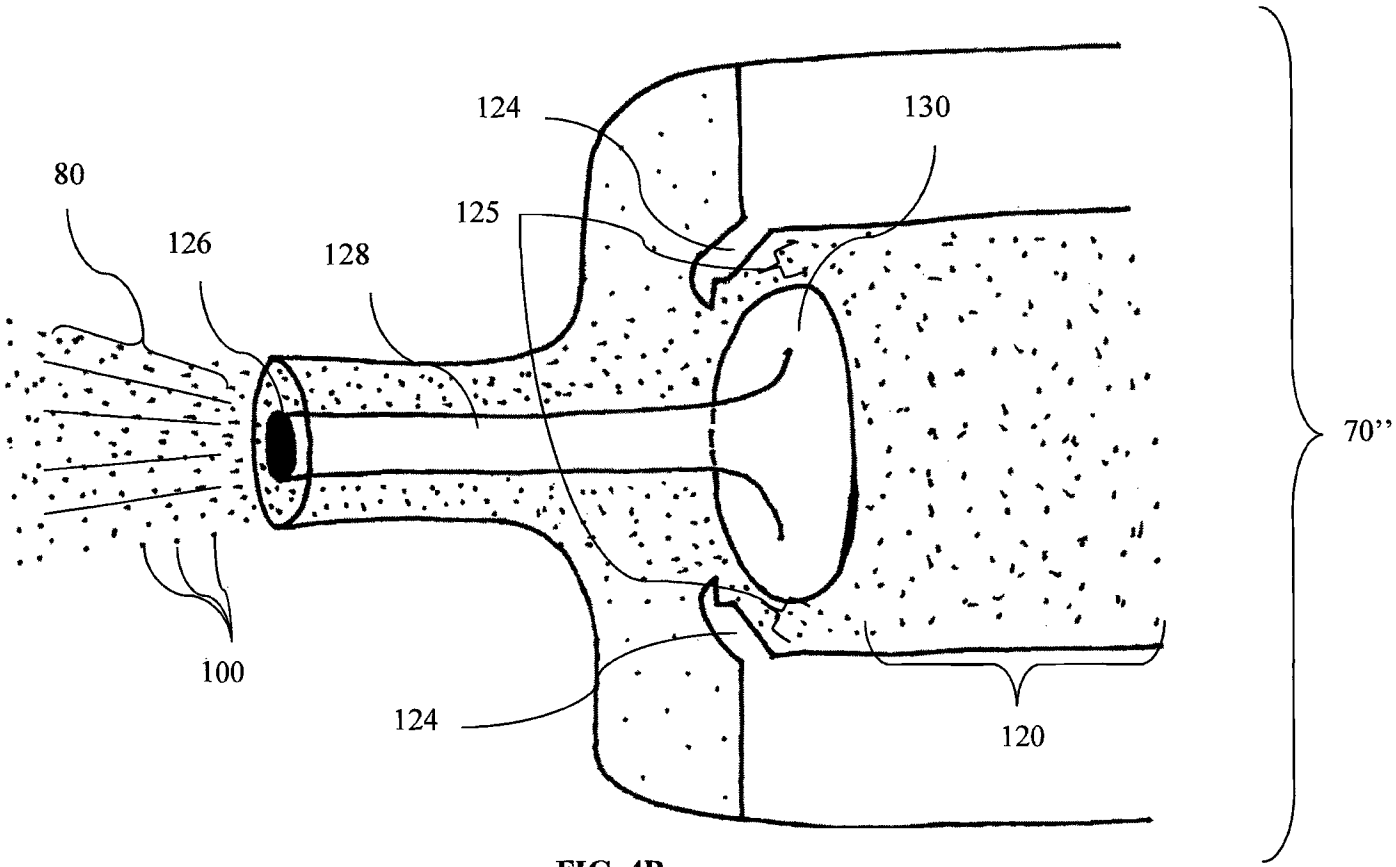
FIG. 4B depicts a cross-sectional view of an alternative exemplary embodiment of the less-than-lethal-agent-emitting element (e.g., underneath the alternative exemplary spray container holding element) with the alternative exemplary spray container in a fully-engaged (fully pushed-forward) position.
Figure 4C:
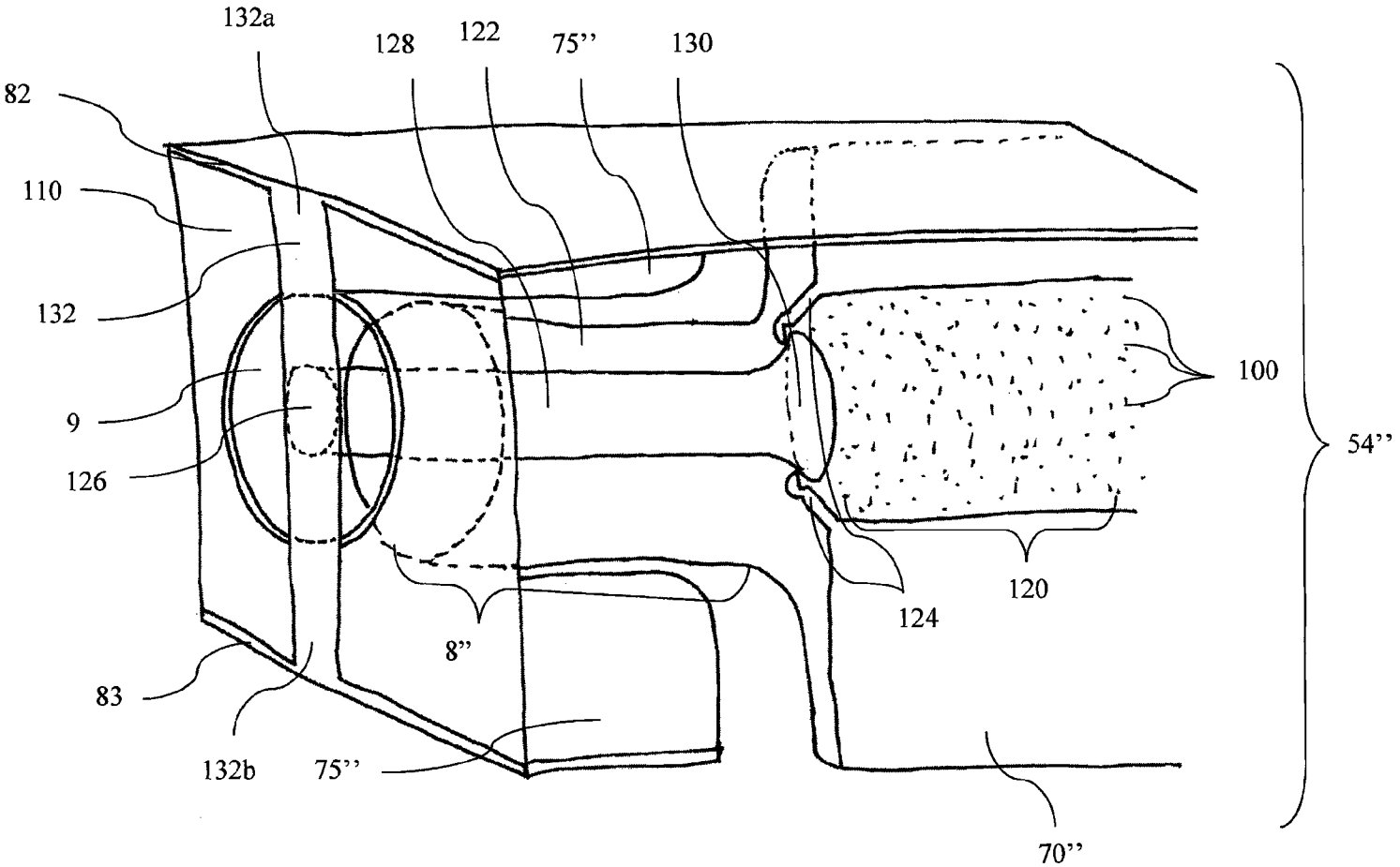
FIG. 4C depicts a side perspective view of an alternative exemplary embodiment of the less-than-lethal-agent-emitting element with an alternative exemplary spray container holding element and with an alternative exemplary spray container in a neutral, fully retracted (non-pushed-forward) position.
Figure 4D:
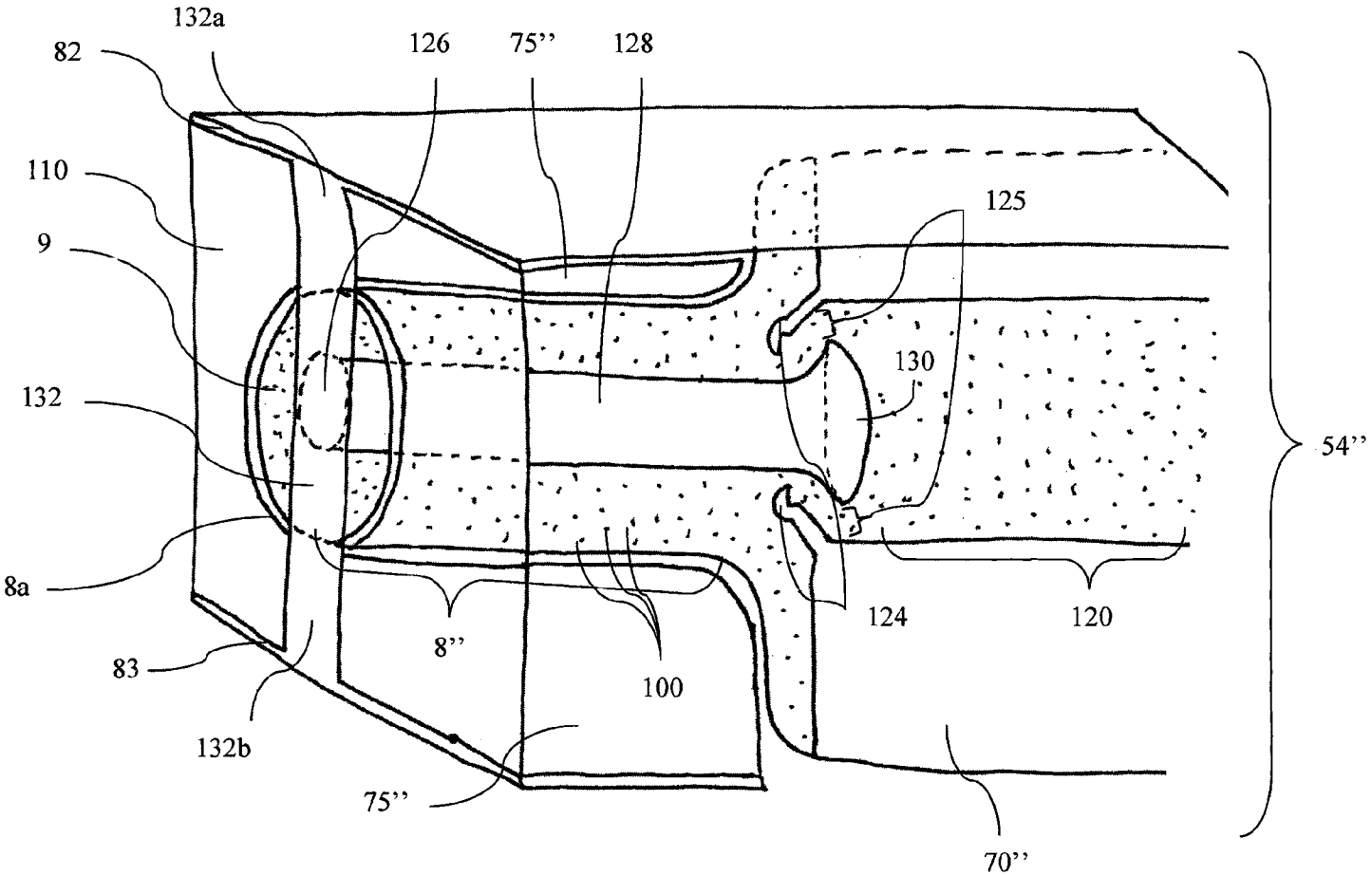
FIG. 4D depicts a side perspective view of an alternative exemplary embodiment of the less-than-lethal-agent-emitting element with an alternative exemplary spray container holding element, and with an alternative exemplary spray container in a fully-engaged (fully pushed-forward) position.

With reference to FIGS. 1A, 1B, 1C, 1D, 1E, 1F, 1G, 4A, 4B, 4C, and 4D, the exemplary spray container support 75" will comprise an exemplary rigid container that will substantially surround and/or encapsulate one or more exemplary lateral side(s) (but not posterior and anterior ends) of the exemplary spray container 70". Further, the exemplary spray container support 75" will comprise an exemplary nozzle guard 132, which will comprise a rectangular horizontal strip (as shown in FIGS. 4C and 4D) and connect to an exemplary spray container support top surface 82 at an exemplary first end 132*a* and an exemplary spray container support bottom surface 83 at an exemplary second end 132*b*, at an exemplary anterior end 110 of the exemplary spray container 75".

The exemplary nozzle guard 132 will be adapted to contact and/or prevent the exemplary forward movement (as depicted in FIG. 4D) of the exemplary plug rod anterior end 128 beyond an exemplary fixed point (as depicted in FIG. 4D, the exemplary location of the exemplary nozzle guard 132). However, it will be understood by those of ordinary skill in the art that depiction and reference to such an exemplary arrangements of, dimensions of, and an exemplary general shape of the aforementioned exemplary components and elements of the exemplary spray container support 75" are illustrative and not a limitation of the invention; other arrangements of, dimensions of, and/or general shape of the aforementioned exemplary components and elements of the alternative exemplary embodiment of the present invention could be used without departing from the spirit of the present invention. For example, the exemplary general shape of the exemplary nozzle guard 132 could be non-rectangular, such as, for example, circle, square, other polygon, a non-polygon shape and/or design, or any multitude of combinations thereof, and/or the exemplary nozzle guard 132 could extend diagonally from any one lateral side, or from more than one lateral side, of the anterior end 110 of the spray container support 75". By way of another example, the exemplary spray container support may not substantially encapsulate the exemplary spray container 70" and/or may instead only enclose and/or only support a small fraction of the exemplary body of the exemplary spray container 70".

Continuing with reference to FIGS. 1A, 1B, 1C, 1D, 1E, 1F, 1G, 4A, 4B, 4C, and 4D, the exemplary spray container 70" will comprise an exemplary rigid rod 128, comprising an exemplary narrow, cylindrical exemplary plug rod anterior end 126 at an exemplary first end, and an exemplary parabolically-widening circular exemplary plug rod poster end 130 at an exemplary second end. The exemplary plug rod anterior end 126 will extend slightly beyond the exemplary anterior end 8*a* of the nozzle 8" and the exemplary plug rod posterior end 130 will contact and/or create an exemplary seal and/or exemplary connection with the exemplary sealing lips 124 when the exemplary plug rod anterior end 126 is at rest (i.e., not depressed against the exemplary nozzle guard 132 (as shown in FIGS. 4A and 4C)).

Further, the exemplary spray container 70" will also comprise an exemplary exposed spray proximal posterior end 56 (as depicted, for example, in FIGS. 1B and 1C), and an exemplary spray container push-forward arm 21 (as depicted, for example, in FIGS. 1A, 1B and 1C), with an exemplary spray container push-forward arm forward end 20, and/or an exemplary spray container push-forward arm rearward end 22. An exemplary user of the exemplary apparatus could apply an exemplary forward force on either the exemplary exposed proximal posterior end 56 or on the exemplary spray container push-forward arm 21 to cause an exemplary forward movement of the exemplary plug rod 128. Once the exemplary plug rod 128 will be sufficiently moved forward, in this exemplary embodiment, the exemplary plug rod anterior end 126 will contact and be depressed by the exemplary nozzle guard 132 (such as depicted in FIGS. 4B and 4D). The exemplary depression will cause the exemplary sealing lips 124 to separate from the exemplary plug rod posterior end 130, thereby causing the exemplary formation of the exemplary push-induced gaps 125 (as depicted in FIGS. 4B and 4D) between the exemplary plug rod posterior end 130 and the exemplary sealing lip 124.

Consequently, in this exemplary embodiment, the exemplary less-than-lethal agent molecules 100 will travel from the exemplary posterior plug space 120 of the exemplary spray container 70" to the exemplary anterior plug space 122 of the exemplary spray container 70". Consequently, the exemplary less-than-lethal agent molecules 100 will be emitted from the exemplary nozzle 8" (as is shown in FIGS. 4B and 4D) in the form of an exemplary targeted spray 80.

Upon the cessation of an exemplary user-applied force onto either the exemplary exposed spray proximal posterior end 56 (as depicted, for example, in FIGS. 1B and 1C) or the exemplary spray container push-forward arm 21 (as depicted, for example, in FIGS. 1A, 1B and 1C), the exemplary plug rod posterior end 130 will return back to an at-rest position (as depicted in FIGS. 4A and 4C) to contact the exemplary sealing lip 124, thereby preventing further emission of the exemplary less-than-lethal agent molecules 100.

However, it will be understood by those of ordinary skill in the art that depiction and reference to such exemplary arrangements of, exemplary dimensions of, exemplary connection points of and/or exemplary movement directions of the aforementioned exemplary components and elements are illustrative and not a limitation of the invention; other arrangements of and/or dimensions and/or connections of and/or movements of the aforementioned exemplary components and elements of the exemplary embodiment of the present invention could be used without departing from the spirit of the present invention. For example, in various alternative exemplary embodiments, the exemplary general shape of the exemplary plug rod posterior end 130 may be wider than, and/or equal to the exemplary diameter of the exemplary plug rod anterior end 126. By way of another example, in various alternative embodiments, the exemplary mode of exemplary user-applied forward-force may not be limited to the exemplary spray container push-forward movement arm 21 and/or exemplary exposed spray proximal posterior end 56 and, thus, may include any functionally-equivalent alternative mode of moving the exemplary spray container 70" in the exemplary forward direction, such as, for example, using an arm positioned in an alternative exemplary location on the front, side, and/or back of the exemplary spray container 70" and/or exemplary spray container support 70".

F. An Exemplary Arrangement of Certain Exemplary Elements Within Multiple Exemplary Enclosures With reference to FIGS. 1A, 1B, 1C, 1D, and 1E, an exemplary arrangement of various exemplary elements within multiple exemplary enclosures (i.e., 52 and 112) will comprise an exemplary first enclosure 52 surrounding an exemplary flashlight element 4 and an exemplary laser light element 2 and an exemplary second exemplary enclosure 112 surrounding an exemplary less-than-lethal-agent emitting element, such as, for example, exemplary less-than-lethal-agent emitting element 54'/54" as depicted in FIGS. 3A-4D, where an exemplary surface of the exemplary first enclosure 52 will comprise an exemplary laser light elevation control 38, an exemplary laser light windage control 40, and/or an exemplary flashlight switch 38, and an exemplary surface of the exemplary second enclosure 112 will comprise an exemplary spray elevation control 10, an exemplary spray windage control 12, an exemplary spray horizontal movement mechanism 26, and an exemplary spray container vertical movement mechanism 28, and/or an exemplary exposed spray proximal posterior end 56. An exemplary localization and/or connectivity of the exemplary first enclosure 52 with respect to the exemplary second enclosure 112 will be on an exemplary bottom-surface-side surface of the exemplary first enclosure. In one embodiment, such exemplary connectivity between the first enclosure 52 and the second enclosure 112 will be readily detachable.

However it will be understood by those of ordinary skill in the art that depiction and reference to such exemplary arrangements of, relative positioning of, and connectivity points by and between the exemplary flashlight element 4, the exemplary laser light element 2, the exemplary less-than-lethal-agent-emitting element 54'/54", the exemplary laser light elevation control 38, the exemplary laser light windage control 40, the exemplary flashlight switch 38, the exemplary spray elevation control 10, the exemplary spray windage control 12, the exemplary spray horizontal movement mechanism 26, the exemplary spray container vertical movement mechanism 28, the exemplary spray proximal posterior end 56, the exemplary first enclosure 52, and/or the second exemplary enclosure 112 are merely illustrative and not a limitation of the invention; other arrangements of and/or dimensions of the aforementioned exemplary components and elements of the exemplary embodiment of the present invention could be used without departing from the spirit of the present invention. For example, in various alternative embodiments, the exemplary second enclosure 112 will be located and connected, not at the exemplary bottom-side-surface of the first enclosure 52, but instead at an exemplary lateral side of the exemplary first enclosure 52.

Some such exemplary two-enclosure embodiments would provide a mounting device, such as the above-described exemplary rail mounting element 61. Alternative two-enclosure embodiments would not have any mounting element, or would provide a mounting element that could be removed from the embodiment so that the two-enclosure embodiment could be used as a standalone device.

G. An Alternative Exemplary Arrangement of Certain Exemplary Elements Within An Exemplary Single Enclosure With reference to FIGS. 1F and 1G, an alternative exemplary embodiment will comprise an exemplary single casing 52' surrounding an exemplary flashlight element 4, an exemplary laser light element 2, and an exemplary less-than-lethal-emitting 54'/54". In such an alternative exemplary embodiment, an exemplary surface of the exemplary single casing 52' will comprise an exemplary laser light elevation control 38, an exemplary laser light windage control 40, an exemplary flashlight switch 38, an exemplary spray elevation control 10, an exemplary spray windage control 12, an exemplary spray horizontal movement mechanism 26, and/or an exemplary spray container vertical movement mechanism 28. An exemplary position of the exemplary laser light element 2 will be at an exemplary top-side, weapon-barrel-proximal-side of the exemplary single enclosure. An exemplary position of the exemplary less-than-lethal-agent-emitting 54'/54" will be at an exemplary bottom-side, weapon-barrel-distal-side of the exemplary single casing 52'. An exemplary position of the flashlight element 4 will be at an exemplary center, that is, between the exemplary position of the exemplary laser light element 2 and the exemplary position of the exemplary less-than-lethal-agent-emitting element 54'/54", of the exemplary single casing 52'.

However it will be understood by those of ordinary skill in the art that depiction and reference to such exemplary arrangements of and relative positions of the exemplary flashlight element 4, the exemplary laser light element 2, the exemplary less-than-lethal-agent-emitting element 54754", the exemplary laser light elevation control 38, the exemplary laser light windage control 40, the exemplary flashlight switch 38, the exemplary spray elevation control 10, the exemplary spray windage control 12, the exemplary spray horizontal movement mechanism 26, and/or the exemplary spray container vertical movement mechanism 28 are merely illustrative and not a limitation of the invention; other arrangements of and/or dimensions of the aforementioned exemplary components and elements of the exemplary embodiment of the present invention could be used without departing from the spirit of the present invention. For example, in various alternative embodiments, the exemplary position of the exemplary laser light element 2 and/or the exemplary position of the less-than lethal-agent-emitting element 54'/54" will be in various alternative arrangements and/or locations within the exemplary single casing 52', such as, for example, the exemplary position of the exemplary less-than-lethal-agent-emitting 54'/54" will be at an exemplary top-side, weapon-barrel-proximal-side of the exemplary single enclosure, and an exemplary position of the exemplary laser light element 2 will be at an exemplary bottom-side, weapon-barrel-distal-side of the exemplary single casing 52'.

Some such exemplary single-enclosure embodiments would provide a mounting device, such as, for example, the above-described exemplary rail mounting element 61, for mounting the single casing 52' to a weapon. Alternative single-enclosure embodiments would not have any mounting element, or would provide a mounting element that could be removed from the embodiment so that the embodiment could be used as a standalone device.

Other features of the invention are implicit in the above-provided description and/or are depicted and/or implicit in the accompanying Figures.

FACSIMILE REPRODUCTION OF COPYRIGHT MATERIAL

A portion of the disclosure of this patent document contains material which is subject to copyright protection by the copyright owner, Timothy Scott Mortimer, and his successors and/or assigns. The copyright owner has no objection to the facsimile reproduction by anyone of the patent document or the patent disclosure, as it appears in the Patent and Trademark Office patent file or records, but otherwise reserves all copyright rights whatsoever.

ILLUSTRATIVE EMBODIMENTS

Although this invention has been described in certain specific embodiments, many additional modifications and variations would be apparent to those skilled in the art. It is, therefore, to be understood that this invention may be practiced otherwise than as specifically described. Moreover, to those skilled in the various arts, the invention itself herein will suggest solutions to other tasks and adaptations for other applications. Thus, the embodiments of the invention described herein should be considered in all respects as illustrative and not restrictive, the scope of the invention to be determined by the appended claims and their equivalents rather than the foregoing description.

What is claimed is:

1. A weapon-mountable apparatus comprising:

a flashlight element comprising a flashlight enclosure element holding a light-emitting source for emitting an expansive beam of light, said flashlight enclosure element comprising an exterior surface, said exterior surface comprising an exterior upper area, an exterior underside area and an exterior side area;

a laser light element that is held within said flashlight enclosure element and adapted for emitting a narrow beam of colored light;

a separate less-than-lethal-agent-emitting enclosure element that is attached to said exterior surface of said flashlight enclosure element, said separate less-than-lethal-agent-emitting enclosure element comprising a cavity and a spray container holding element for holding a spray container for causing a targeted spray of a less-than-lethal agent from said spray container, and said exterior upper area of said flashlight enclosure element comprising a rail mounting element adapted for attachment of said flashlight enclosure element to an underside of a weapon; and a spray directional control element comprising either a spray windage control element that, when activated, adjusts a horizontal direction of said targeted spray, or a spray elevation control element that, when activated, adjusts a vertical direction of said targeted spray.

2. The apparatus of claim 1 wherein said flashlight element further comprises a light activation element that is located on said flashlight enclosure element and adapted to activate and/or deactivate said light emitting source.

3. The apparatus of claim 2, wherein said light activation element of said flashlight element comprises a flashlight switch element located on a lateral side of said flashlight enclosure element.

4. The apparatus of claim 2, wherein said light activation element of said flashlight element comprises a flashlight latch element located on the posterior end of said flashlight enclosure element.

5. The apparatus of claim 2, wherein said flashlight element further comprises a hardened crenellated bezel that is adapted to be used as a defensive tool for striking an aggressor.

6. The apparatus of claim 1, wherein said rail mounting element comprises:

a rail mounting receiving cavity that is adapted for receiving a weapon mounting rail; and a rail mounting lip that is adapted to grasp and prevent inadvertent dislodgment from said weapon mounting rail.

7. The apparatus of claim 1, wherein:

said spray container holding element of said separate less-than-lethal-agent-emitting enclosure element further comprises:

a rigid spray nozzle support element that is adapted to maintain a nozzle of said spray container in a fixed position, and an elastic spray container retention band at a first end that is adapted for stretchable retention of said spray container; and said spray container of said less-than-lethal-agent-emitting element comprises:

a nozzle, a spray container vertical movement arm that is connected to a posterior portion of said spray container and adapted for the downward movement of said spray container upon application of a user-applied downward force thereon, and a bendable nozzle-container connection comprising a rod-nozzle hinge that pivotally connects a spray nozzle and a rigid rod of said spray container, and a rod-nozzle seal element that is adapted for preventing said less-than-lethal agent molecules from escaping through a hinge-induced separation when said rod-nozzle hinge is not engaged.

8. The apparatus of claim 7, wherein said spray container of said less-than-lethal-agent-emitting element is adapted to be removable from said spray container holding element and replaceable with another similar spray container.

9. The apparatus of claim 7, wherein said laser light element is positioned in one or both of a two top- and center-most half-quadrants of said flashlight element.

10. The apparatus of claim 1, wherein:

said spray container holding element of said separate less-than-lethal-agent-emitting enclosure element further comprises:

a rigid spray container support element that is adapted to disallow vertical movement but allow horizontal movement of said spray container, and a nozzle guard element that is adapted to prevent horizontal movement of a plug rod anterior end past a certain point; and said spray container of said less-than-lethal-agent-emitting element comprises:

a plug rod, a spray distal end, a spray container horizontal movement arm adapted for connection to a posterior portion of said spray container, and a sealing lip that is adapted for preventing said less-than-lethal agent molecules from escaping through a push-induced gap that is created between a posterior end of said plug rod prior to user-applied forward force to said spray distal end and/or spray container horizontal movement arm.

11. The apparatus of claim 1, wherein:

said flashlight element further comprises:

a hardened crenellated bezel that is adapted to be used as a defensive tool for striking an aggressor, and a light activation element that is adapted to activate and/or deactivate said light emitting source and comprising a flashlight switch element located on a lateral side of said flashlight enclosure element, and a flashlight latch element located on the posterior end of said flashlight enclosure element;

said laser light element comprises:

a laser light windage control element that is adapted for calibrating a horizontal dimension of said narrow beam of colored light, and a laser light elevation control element that is adapted for calibration of a vertical dimension of said narrow beam of colored light;

said rail mounting element comprises:

a rail mounting receiving cavity that is adapted for receiving a weapon mounting rail, and a rail mounting lip that is adapted to grasp and prevent inadvertent dislodgment from said weapon mounting rail;

said spray container holding element of said less-than-lethal-agent-emitting element comprises:

a rigid spray nozzle support element that is adapted to maintain a nozzle of said spray container in a fixed position, and an elastic spray container retention band at a first end that is adapted to stretchable retention of said spray container; and said spray container of said less-than-lethal-agent-emitting element comprises:

a nozzle, a spray container vertical movement arm that is connected to a posterior portion of said spray container and adapted for the downward movement of said spray container upon application of a user-applied downward force thereon, and a bendable nozzle-container connection comprising a rod-nozzle hinge that pivotally connects a spray nozzle and a rigid rod of said spray container, and a rod-nozzle seal element that is adapted for preventing said less-than-lethal agent molecules from escaping through a hinge-induced separation when said rod-nozzle hinge is not engaged.

12. The apparatus of claim 1, wherein:

said flashlight element further comprises:

a hardened crenellated bezel that is adapted to be used as a defensive tool for striking an aggressor, and a light activation element that is adapted to activate and/or deactivate said light emitting source and comprising a flashlight switch element located on a lateral side of said flashlight enclosure element, and a flashlight latch element located on the posterior end of said flashlight enclosure element;

said laser light element comprises:

a laser light windage control element that is adapted for calibrating a horizontal dimension of said narrow beam of colored light, and a laser light elevation control element that is adapted for calibration of a vertical dimension of said narrow beam of colored light;

said rail mounting element comprises:

a rail mounting receiving cavity that is adapted for receiving a weapon mounting rail, and a rail mounting lip that is adapted to grasp and prevent inadvertent dislodgment from said weapon mounting rail;

said spray container holding element of said less-than-lethal-agent-emitting element comprises:

a rigid spray container support element that is adapted to disallow vertical movement but allow horizontal movement of said spray container, and a nozzle guard element that is adapted to prevent horizontal movement of a plug rod anterior end past a certain point; and said spray container of said less-than-lethal-agent-emitting element comprises:

a plug rod, a spray distal end, a spray container horizontal movement arm adapted for connection to a posterior portion of said spray container, and a sealing lip that is adapted for preventing said less-than-lethal agent molecules from escaping through a push-induced gap that is created between a posterior end of said plug rod prior to user-applied forward force to said spray distal end and/or spray container horizontal movement arm.

13. The weapon-mountable apparatus of claim 1, wherein said separate less-than-lethal-agent-emitting enclosure element further comprises a spray-container-arm opening, said weapon-mountable apparatus further comprising:

a spray container seated in said spray container holding element in said cavity, said spray container comprising an exterior surface, said exterior surface of said spray container comprising a push-down arm that extends through said spray-container-arm opening.

14. The weapon-mountable apparatus of claim 1, wherein said separate less-than-lethal-agent-emitting enclosure element that is attached to said exterior underside area of said exterior surface of said flashlight enclosure element.

15. The weapon-mountable apparatus of claim 1, wherein said separate less-than-lethal-agent-emitting enclosure element that is attached to said exterior side area of said exterior surface of said flashlight enclosure element.

16. An apparatus comprising:

an enclosure element, said enclosure element comprising an exterior surface, said exterior surface comprising a spray-container-arm opening;

a flashlight element that is held within said enclosure element, said flashlight element comprising a broad-light emitting source for emitting a broad beam of light;

a laser light element that is held within said enclosure element, said laser light element comprising a narrow-beam-of-light emitting source for emitting a narrow beam of light;

a spray container held in said flashlight enclosure element, said spray container comprising a spray nozzle, said spray container further comprising an exterior surface, said exterior surface of said spray container comprising a push-down arm that extends through said spray-container-arm opening; and a spray directional control element comprising either a spray windage control element that, when activated, adjusts a horizontal direction of a spray emitted from said spray nozzle, or a spray elevation control element that, when activated, adjusts a vertical direction of a spray emitted from said spray nozzle.

17. The apparatus of claim 16, said apparatus further comprising:

a rail mounting element on said exterior upper area of said exterior surface of said enclosure element, said rail mounting element adapted for attachment of said enclosure element to an underside of a weapon.

* * * * *